US010832833B2

(12) United States Patent
Wehrli et al.

(10) Patent No.: US 10,832,833 B2
(45) **Date of Patent: *Nov. 10, 2020**

(54) HIGH PERFORMANCE DATA COMMUNICATIONS CABLE

(71) Applicant: Belden Inc., St. Louis, MO (US)

(72) Inventors: Andrew John Wehrli, Monticello, KY (US); William Thomas Clark, Richmond, IN (US); Galen Mark Gareis, Oxford, OH (US); Douglas David Brenneke, Oxford, OH (US)

(73) Assignee: BELDEN INC, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/356,825

(22) Filed: Mar. 18, 2019

(65) Prior Publication Data

US 2019/0214163 A1 Jul. 11, 2019

Related U.S. Application Data

(63) Continuation of application No. 15/996,161, filed on Jun. 1, 2018, now Pat. No. 10,236,099, which is a (Continued)

(51) Int. Cl.
*H01B 11/00* (2006.01)
*H01B 11/06* (2006.01)

(Continued)

(52) U.S. Cl.
CPC ..... *H01B 11/06* (2013.01); *H01B 11/002* (2013.01); *H01B 11/1008* (2013.01); *H01B 11/1847* (2013.01); *Y10T 29/49201* (2015.01)

(58) Field of Classification Search
CPC ... H01B 7/02; H01B 7/04; H01B 7/06; H01B 9/02; H01B 9/04

(Continued)

(56) References Cited

U.S. PATENT DOCUMENTS 3,622,683 A 11/1971 Roberts et al.
4,085,284 A 4/1978 Olszewski et al.

(Continued)

FOREIGN PATENT DOCUMENTS

CN 102067244 A 5/2011
GB 0 988 789 4/1965

(Continued)

OTHER PUBLICATIONS

Chinese Office Action on CN 201480057975.6 dated Mar. 2, 2017, 21 pages.

(Continued)

*Primary Examiner* — William H. Mayo, III
(74) *Attorney, Agent, or Firm* — Foley & Lardner LLP

(57) ABSTRACT

Two electromagnetic interference (EMI) controlling tape application methodologies for unshielded twisted pair (UTP) cable include Fixed Tape Control (FTC) and Oscillating Tape Control (OTC). In FTC, tape application angle and edge placement are controlled to maintain position of the tape edges over a base of nonconductive filler in the cable. In OTC, the tape application angle is continuously varied, resulting in crossing of the tape edges over all of the pairs of conductors with varying periodicity. In both implementations, the filler allows a cylindrical shape.

50 Claims, 25 Drawing Sheets

Related U.S. Application Data continuation of application No. 15/610,504, filed on May 31, 2017, now Pat. No. 9,991,030, which is a continuation of application No. 14/520,125, filed on Oct. 21, 2014, now Pat. No. 9,697,929.

(60) Provisional application No. 61/894,728, filed on Oct. 23, 2013.

(51) Int. Cl.
*H01B 11/18* (2006.01)
*H01B 11/10* (2006.01)

(58) Field of Classification Search
USPC ..... 174/110 R, 113 R, 113 C, 120 R, 102 R
See application file for complete search history.

(56) References Cited

U.S. PATENT DOCUMENTS

| | | | | |
|---|---|---|---|---|
| 4,125,739 | A | 11/1978 | Bow | |
| 4,165,442 | A | 8/1979 | Gabriel et al. | |
| 4,340,771 | A | 7/1982 | Watts | |
| 4,453,031 | A | 6/1984 | Justiss | |
| 6,365,836 | B1 | 4/2002 | Blouin et al. | |
| 6,570,095 | B2 | 5/2003 | Clark et al. | |
| 6,812,408 | B2 * | 11/2004 | Clark | H01B 11/04 174/113 C |
| 7,491,888 | B2 | 2/2009 | Clark et al. | |
| 8,729,394 | B2 | 5/2014 | Clark et al. | |
| 8,927,866 | B2 | 1/2015 | Nordin et al. | |
| 2006/0169478 | A1 | 8/2006 | Clark | |
| 2007/0037419 | A1 * | 2/2007 | Sparrowhawk | H01B 11/1008 439/98 |
| 2007/0163800 | A1 | 7/2007 | Clark et al. | |
| 2009/0223694 | A1 | 9/2009 | Nordin et al. | |
| 2009/0294146 | A1 | 12/2009 | Nordin et al. | |
| 2010/0282493 | A1 * | 11/2010 | Nordin | H01B 11/1008 174/113 R |
| 2011/0259626 | A1 | 10/2011 | Speer | |
| 2012/0222883 | A1 * | 9/2012 | Nordin | H01B 11/08 174/113 C |
| 2012/0227998 | A1 | 9/2012 | Lindstrom et al. | |
| 2012/0312579 | A1 | 12/2012 | Kenny et al. | |

FOREIGN PATENT DOCUMENTS

| | | | |
|---|---|---|---|
| WO | WO-2009/143145 | A1 | 11/2009 |
| WO | WO-2011/009006 | A1 | 1/2011 |

OTHER PUBLICATIONS

Chinese Office Action on CN 201480057975.6 dated May 2, 2018, 11 pages.
Chinese Office Action on CN 201480057975.6 dated Oct. 19, 2017, 8 pages.
Chinese Office Action on CN 201711419740.9, dated Mar. 7, 2019, 10 pages.
Communication pursuant to Article 94(3) EPC on EP 14793398.0 dated Feb. 2, 2017, 4 pages.
Communication pursuant to Article 94(3) EPC on EP 17205525.3 dated Feb. 22, 2019, 8 pages.
European Search Report and Search Opinion on EP 17205525.3 dated Feb. 21, 2018, 9 pages.
International Preliminary Report on Patentability on International Application No. PCT/US2014/061618 dated May 6, 2016, 8 pages.
International Search Report and Written Opinion for International Application No. PCT/US2014/061618 dated Jan. 26, 2015, 30 pages.
Notice of Allowance on U.S. Appl. No. 15/996,161 dated Nov. 6, 2018, 13 pages.
U.S. Notice of Allowance on U.S. Appl. No. 14/520,125 dated Mar. 27, 2017, 9 pages.
U.S. Notice of Allowance on U.S. Appl. No. 15/610,504 dated Apr. 11, 2018, 9 pages.
U.S. Office Action on 096001-1132 dated Nov. 2, 2015, 18 pages.
U.S. Office Action on U.S. Appl. No. 14/520,125 dated Jun. 8, 2016, 22 pages.
U.S. Office Action on U.S. Appl. No. 14/520,125 dated Oct. 7, 2016, 15 pages.
U.S. Office Action on U.S. Appl. No. 15/610,504 dated Jan. 16, 2018, 6 pages.
U.S. Office Action on U.S. Appl. No. 15/610,504 dated Jul. 3, 2017, 19 pages.

* cited by examiner

Longitudinal Tape

| PSANEXT, Telecom Room side | | | Spec. TIA | |
|---|---|---|---|---|
| Freq. | Worst Case | Average | Ind | Average |
| 1 | 103.3 | 104.6 | 67.0 | na |
| 4 | 105.0 | 106.3 | 67.0 | na |
| 8 | 90.6 | 96.5 | 67.0 | na |
| 10 | 95.6 | 102.7 | 67.0 | na |
| 16 | 94.7 | 100.7 | 67.0 | na |
| 20 | 85.4 | 90.5 | 67.0 | na |
| 25 | 88.4 | 97.4 | 67.0 | na |
| 31 | 83.1 | 89.2 | 67.0 | na |
| 62 | 72.8 | 78.7 | 65.6 | na |
| 100 | 92.0 | 95.1 | 62.5 | na |
| 160 | 75.8 | 84.5 | 59.4 | na |
| 200 | 82.3 | 86.5 | 58.0 | na |
| 250 | 84.9 | 90.5 | 56.5 | na |
| 300 | 84.1 | 90.6 | 55.3 | na |
| 350 | 79.1 | 83.1 | 54.3 | na |
| 400 | 77.4 | 82.7 | 53.5 | na |
| 450 | 78.1 | 82.0 | 52.7 | na |
| 500 | 85.4 | 87.0 | 52.0 | na |
| 550 | 79.0 | 80.3 | na | na |
| 600 | 86.0 | 89.6 | na | na |
| 625 | 85.9 | 90.2 | na | na |

| PSANEXT, Work Area side | | | Spec. TIA | |
|---|---|---|---|---|
| Freq. | Worst Case | Average | Ind | Average |
| 1 | 104.8 | 105.2 | 67.0 | na |
| 4 | 103.2 | 106.1 | 67.0 | na |
| 8 | 89.3 | 94.9 | 67.0 | na |
| 10 | 95.7 | 101.7 | 67.0 | na |
| 16 | 91.6 | 99.3 | 67.0 | na |
| 20 | 88.0 | 92.8 | 67.0 | na |
| 25 | 91.0 | 97.2 | 67.0 | na |
| 31 | 84.1 | 90.3 | 67.0 | na |
| 62 | 75.9 | 79.7 | 65.6 | na |
| 100 | 98.3 | 102.0 | 62.5 | na |
| 160 | 80.2 | 91.8 | 59.4 | na |
| 200 | 81.7 | 84.7 | 58.0 | na |
| 250 | 75.9 | 84.3 | 56.5 | na |
| 300 | 79.2 | 84.8 | 55.3 | na |
| 350 | 82.3 | 86.0 | 54.3 | na |
| 400 | 74.5 | 82.6 | 53.5 | na |
| 450 | 81.0 | 85.0 | 52.7 | na |
| 500 | 88.1 | 89.9 | 52.0 | na |
| 550 | 77.7 | 81.1 | na | na |
| 600 | 86.7 | 89.0 | na | na |
| 625 | 85.7 | 87.2 | na | na |

Longitudinal Tape

| PSAACRF, Telecom Room side | | | Spec. TIA | |
|---|---|---|---|---|
| Freq. | Worst Case | Average | ind | Average |
| 1 | 102.7 | 103.6 | 67.0 | na |
| 4 | 104.9 | 105.6 | 66.2 | na |
| 8 | 103.5 | 105.5 | 60.1 | na |
| 10 | 104.0 | 104.6 | 58.2 | na |
| 16 | 89.4 | 96.1 | 54.1 | na |
| 20 | 86.6 | 91.6 | 52.2 | na |
| 25 | 95.7 | 100.7 | 50.2 | na |
| 31 | 84.6 | 91.2 | 48.4 | na |
| 62 | 75.5 | 79.9 | 42.4 | na |
| 100 | 89.1 | 92.7 | 38.2 | na |
| 160 | 69.5 | 77.5 | 34.1 | na |
| 200 | 84.5 | 89.5 | 32.2 | na |
| 250 | 80.3 | 87.5 | 30.2 | na |
| 300 | 78.4 | 83.8 | 28.7 | na |
| 350 | 69.1 | 75.8 | 27.3 | na |
| 400 | 78.3 | 79.4 | 26.2 | na |
| 450 | 81.4 | 84.0 | 25.1 | na |
| 500 | 84.0 | 86.5 | 24.2 | na |
| 550 | 74.6 | 78.5 | na | na |
| 600 | 75.3 | 79.3 | na | na |
| 625 | 81.1 | 82.5 | na | na |

| PSAACRF, Work Area side | | | Spec. TIA | |
|---|---|---|---|---|
| Freq. | Worst Case | Average | ind | Average |
| 1 | 102.1 | 102.8 | 67.0 | na |
| 4 | 104.9 | 105.1 | 66.2 | na |
| 8 | 99.7 | 102.1 | 60.1 | na |
| 10 | 102.5 | 103.9 | 58.2 | na |
| 16 | 92.2 | 100.6 | 54.1 | na |
| 20 | 82.4 | 87.3 | 52.2 | na |
| 25 | 103.2 | 108.2 | 50.2 | na |
| 31 | 80.4 | 86.6 | 48.4 | na |
| 62 | 78.3 | 82.2 | 42.4 | na |
| 100 | 84.3 | 88.9 | 38.2 | na |
| 160 | 71.3 | 79.9 | 34.1 | na |
| 200 | 88.3 | 89.9 | 32.2 | na |
| 250 | 73.9 | 84.0 | 30.2 | na |
| 300 | 83.3 | 86.2 | 28.7 | na |
| 350 | 71.9 | 78.6 | 27.3 | na |
| 400 | 79.0 | 81.9 | 26.2 | na |
| 450 | 73.4 | 78.3 | 25.1 | na |
| 500 | 80.4 | 85.6 | 24.2 | na |
| 550 | 70.0 | 73.1 | na | na |
| 600 | 81.2 | 82.0 | na | na |
| 625 | 78.7 | 82.4 | na | na |

Helical Tape

| PSANEXT, Telecom Room side | | | Spec. TIA | |
|---|---|---|---|---|
| Freq. | Worst Case | Average | ind | Average |
| 1 | 96.4 | 104.2 | 67.0 | na |
| 4 | 102.0 | 104.0 | 67.0 | na |
| 8 | 99.7 | 104.9 | 67.0 | na |
| 10 | 101.6 | 104.3 | 67.0 | na |
| 16 | 100.7 | 103.8 | 67.0 | na |
| 20 | 97.0 | 103.2 | 67.0 | na |
| 25 | 101.7 | 105.9 | 67.0 | na |
| 31 | 90.5 | 95.9 | 67.0 | na |
| 62 | 80.2 | 81.6 | 65.6 | na |
| 100 | 82.0 | 86.3 | 62.5 | na |
| 160 | 87.5 | 91.0 | 59.4 | na |
| 200 | 80.7 | 84.6 | 58.0 | na |
| 250 | 81.9 | 85.8 | 56.5 | na |
| 300 | 81.7 | 85.9 | 55.3 | na |
| 350 | 78.0 | 80.7 | 54.3 | na |
| 400 | 85.1 | 89.9 | 53.5 | na |
| 450 | 77.5 | 81.7 | 52.7 | na |
| 500 | 77.4 | 82.9 | 52.0 | na |
| 550 | 79.3 | 84.5 | na | na |
| 600 | 79.3 | 83.3 | na | na |
| 625 | 75.7 | 80.0 | na | na |

| PSANEXT, Work Area side | | | Spec. TIA | |
|---|---|---|---|---|
| Freq. | Worst Case | Average | ind | Average |
| 1 | 101.0 | 104.8 | 67.0 | na |
| 4 | 98.0 | 105.8 | 67.0 | na |
| 8 | 99.0 | 102.3 | 67.0 | na |
| 10 | 100.2 | 103.0 | 67.0 | na |
| 16 | 99.9 | 107.5 | 67.0 | na |
| 20 | 96.4 | 100.8 | 67.0 | na |
| 25 | 103.0 | 106.8 | 67.0 | na |
| 31 | 92.2 | 94.9 | 67.0 | na |
| 62 | 93.0 | 96.1 | 65.6 | na |
| 100 | 75.7 | 79.3 | 62.5 | na |
| 160 | 91.9 | 95.1 | 59.4 | na |
| 200 | 75.9 | 80.5 | 58.0 | na |
| 250 | 84.0 | 88.0 | 56.5 | na |
| 300 | 80.8 | 85.9 | 55.3 | na |
| 350 | 82.4 | 87.9 | 54.3 | na |
| 400 | 80.6 | 86.9 | 53.5 | na |
| 450 | 79.9 | 82.5 | 52.7 | na |
| 500 | 84.4 | 85.8 | 52.0 | na |
| 550 | 79.0 | 82.6 | na | na |
| 600 | 73.6 | 80.6 | na | na |
| 625 | 74.7 | 88.2 | na | na |

Helical Tape

| PSAACRF, Telecom Room side | | | Spec. TIA | |
|---|---|---|---|---|
| Freq. | Worst Case | Average | ind | Average |
| 1 | 101.6 | 102.5 | 67.0 | na |
| 4 | 103.1 | 104.9 | 58.2 | na |
| 8 | 103.4 | 109.3 | 60.1 | na |
| 10 | 102.7 | 111.6 | 58.2 | na |
| 16 | 96.5 | 104.2 | 54.1 | na |
| 20 | 98.6 | 99.8 | 52.2 | na |
| 25 | 99.5 | 102.1 | 50.2 | na |
| 31 | 95.0 | 95.6 | 48.4 | na |
| 62 | 84.4 | 88.5 | 42.6 | na |
| 100 | 76.4 | 83.1 | 38.2 | na |
| 150 | 90.3 | 92.9 | 34.1 | na |
| 200 | 76.9 | 80.9 | 32.2 | na |
| 250 | 79.7 | 85.3 | 30.2 | na |
| 300 | 74.1 | 80.8 | 28.7 | na |
| 350 | 77.9 | 80.8 | 27.3 | na |
| 400 | 77.9 | 80.9 | 26.2 | na |
| 450 | 75.6 | 77.1 | 25.1 | na |
| 500 | 76.6 | 79.5 | 24.2 | na |
| 550 | 70.8 | 74.0 | na | na |
| 600 | 65.8 | 69.0 | na | na |
| 625 | 67.4 | 72.4 | na | na |

| PSAACRF, Work Area side | | | Spec. TIA | |
|---|---|---|---|---|
| Freq. | Worst Case | Average | ind | Average |
| 1 | 100.6 | 101.2 | 67.0 | na |
| 4 | 101.2 | 102.3 | 66.2 | na |
| 8 | 103.1 | 104.5 | 60.1 | na |
| 10 | 104.0 | 105.4 | 58.2 | na |
| 16 | 96.7 | 101.9 | 54.1 | na |
| 20 | 97.7 | 101.1 | 52.2 | na |
| 25 | 101.9 | 105.0 | 50.2 | na |
| 31 | 89.9 | 92.6 | 48.4 | na |
| 62 | 86.9 | 91.7 | 42.4 | na |
| 100 | 80.7 | 83.0 | 38.2 | na |
| 150 | 88.1 | 92.8 | 34.1 | na |
| 200 | 81.7 | 85.6 | 32.2 | na |
| 250 | 85.4 | 87.2 | 30.2 | na |
| 300 | 77.7 | 85.4 | 28.7 | na |
| 350 | 75.2 | 78.8 | 27.3 | na |
| 400 | 75.6 | 79.1 | 26.2 | na |
| 450 | 73.9 | 77.3 | 25.1 | na |
| 500 | 76.9 | 78.3 | 24.2 | na |
| 550 | 76.9 | 78.8 | na | na |
| 600 | 73.8 | 76.6 | na | na |
| 625 | 70.5 | 75.6 | na | na |

Spiral Tape

| PSANEXT, Telecom Room side | | | Spec. TIA | |
|---|---|---|---|---|
| Freq. | Worst Case | Average | ind | Average |
| 1 | 102.0 | 103.3 | 67.0 | na |
| 4 | 100.0 | 104.4 | 67.0 | na |
| 8 | 88.3 | 93.8 | 67.0 | na |
| 10 | 59.4 | 69.2 | 67.0 | na |
| 16 | 74.3 | 79.7 | 67.0 | na |
| 20 | 55.5 | 61.9 | 67.0 | na |
| 25 | 57.7 | 63.7 | 67.0 | na |
| 31 | 63.1 | 69.3 | 67.0 | na |
| 62 | 73.2 | 77.7 | 65.6 | na |
| 100 | 75.1 | 79.6 | 62.5 | na |
| 160 | 74.6 | 78.4 | 59.4 | na |
| 200 | 75.5 | 77.5 | 58.0 | na |
| 250 | 76.0 | 79.0 | 56.5 | na |
| 300 | 73.8 | 78.3 | 55.3 | na |
| 350 | 72.4 | 75.9 | 54.3 | na |
| 400 | 75.2 | 77.5 | 53.5 | na |
| 450 | 73.2 | 75.3 | 52.7 | na |
| 500 | 75.2 | 76.8 | 52.0 | na |
| 550 | 74.2 | 77.3 | na | na |
| 600 | 74.1 | 74.4 | na | na |
| 625 | 69.1 | 71.8 | na | na |

| PSANEXT, Work Area side | | | Spec. TIA | |
|---|---|---|---|---|
| Freq. | Worst Case | Average | ind | Average |
| 1 | 96.1 | 98.8 | 67.0 | na |
| 4 | 101.4 | 103.3 | 67.0 | na |
| 8 | 87.1 | 96.4 | 67.0 | na |
| 10 | 59.3 | 68.4 | 67.0 | na |
| 16 | 73.8 | 79.1 | 67.0 | na |
| 20 | 55.7 | 61.9 | 67.0 | na |
| 25 | 57.7 | 64.2 | 67.0 | na |
| 31 | 64.1 | 68.2 | 67.0 | na |
| 62 | 76.7 | 79.6 | 65.6 | na |
| 100 | 77.2 | 79.3 | 62.5 | na |
| 160 | 73.2 | 77.0 | 59.4 | na |
| 200 | 74.3 | 76.3 | 58.0 | na |
| 250 | 77.9 | 80.6 | 56.5 | na |
| 300 | 77.4 | 79.1 | 55.3 | na |
| 350 | 73.0 | 75.7 | 54.3 | na |
| 400 | 71.7 | 75.1 | 53.5 | na |
| 450 | 74.8 | 78.5 | 52.7 | na |
| 500 | 73.8 | 75.5 | 52.0 | na |
| 550 | 72.5 | 74.5 | na | na |
| 600 | 70.0 | 73.9 | na | na |
| 625 | 69.2 | 75.0 | na | na |

Spiral Tape

| PSAACRF, Telecom Room side | | | Spec. TIA | |
|---|---|---|---|---|
| Freq. | Worst Case | Average | std | Average |
| 1 | 100.6 | 108.8 | 67.0 | na |
| 4 | 99.8 | 102.0 | 66.2 | na |
| 8 | 100.1 | 104.8 | 60.1 | na |
| 10 | 88.4 | 88.0 | 58.2 | na |
| 16 | 71.6 | 77.3 | 54.1 | na |
| 20 | 64.6 | 61.0 | 52.2 | na |
| 25 | 57.9 | 63.5 | 50.2 | na |
| 31 | 58.1 | 64.5 | 48.4 | na |
| 62 | 64.7 | 71.5 | 42.4 | na |
| 100 | 58.6 | 65.8 | 38.2 | na |
| 160 | 56.6 | 65.1 | 34.1 | na |
| 200 | 54.7 | 65.0 | 32.2 | na |
| 250 | 54.1 | 66.8 | 30.2 | na |
| 300 | 53.5 | 61.8 | 28.7 | na |
| 350 | 51.5 | 61.9 | 27.3 | na |
| 400 | 51.6 | 61.2 | 26.2 | na |
| 450 | 50.4 | 59.7 | 25.1 | na |
| 500 | 50.1 | 61.5 | 24.2 | na |
| 350 | 49.9 | 62.8 | na | na |
| 650 | 50.4 | 58.3 | na | na |
| 625 | 50.4 | 58.3 | na | na |

| PSAACRF, Work Area side | | | Spec. TIA | |
|---|---|---|---|---|
| Freq. | Worst Case | Average | std | Average |
| 1 | 94.6 | 102.8 | 67.0 | na |
| 4 | 104.8 | 108.7 | 66.2 | na |
| 8 | 95.6 | 97.6 | 60.1 | na |
| 10 | 88.4 | 87.4 | 58.2 | na |
| 16 | 72.0 | 77.8 | 54.1 | na |
| 20 | 65.3 | 61.3 | 52.2 | na |
| 25 | 58.7 | 64.3 | 50.2 | na |
| 31 | 60.0 | 65.3 | 48.4 | na |
| 62 | 65.7 | 71.3 | 40.4 | na |
| 100 | 59.2 | 67.4 | 38.2 | na |
| 160 | 55.8 | 65.8 | 34.1 | na |
| 200 | 55.7 | 63.2 | 32.2 | na |
| 250 | 53.7 | 64.7 | 30.2 | na |
| 300 | 52.6 | 62.1 | 28.7 | na |
| 350 | 51.0 | 63.2 | 27.3 | na |
| 400 | 50.5 | 60.9 | 26.2 | na |
| 450 | 49.9 | 61.7 | 25.1 | na |
| 500 | 50.0 | 61.3 | 24.2 | na |
| 550 | 49.7 | 61.4 | na | na |
| 600 | 50.0 | 59.1 | na | na |
| 625 | 50.3 | 59.6 | na | na |

Fixed Tape – Incorrect tape edge location

| PSANEXT, Telecom Room side | | | Spec. TIA | |
|---|---|---|---|---|
| Freq. | Worst Case | Average | ind | Average |
| 1 | 95.9 | 97.9 | 67.0 | na |
| 4 | 103.3 | 106.7 | 67.0 | na |
| 8 | 100.3 | 103.3 | 67.0 | na |
| 10 | 99.9 | 102.5 | 67.0 | na |
| 16 | 95.1 | 97.9 | 67.0 | na |
| 20 | 97.0 | 99.9 | 67.0 | na |
| 25 | 99.8 | 101.5 | 67.0 | na |
| 31 | 92.6 | 95.9 | 67.0 | na |
| 62 | 72.2 | 75.4 | 65.5 | na |
| 100 | 82.6 | 87.4 | 62.5 | na |
| 160 | 93.7 | 96.2 | 59.4 | na |
| 200 | 76.0 | 87.4 | 58.0 | na |
| 250 | 79.9 | 85.5 | 56.5 | na |
| 300 | 82.0 | 86.4 | 55.3 | na |
| 350 | 80.8 | 84.8 | 54.3 | na |
| 400 | 75.5 | 83.4 | 53.5 | na |
| 450 | 75.8 | 84.0 | 52.7 | na |
| 500 | 73.5 | 79.6 | 52.0 | na |
| 550 | 68.4 | 75.2 | na | na |
| 600 | 70.6 | 75.2 | na | na |
| 625 | 68.5 | 72.9 | na | na |

| PSANEXT, Work Area side | | | Spec. TIA | |
|---|---|---|---|---|
| Freq. | Worst Case | Average | ind | Average |
| 1 | 101.4 | 103.8 | 67.0 | na |
| 4 | 101.4 | 105.9 | 67.0 | na |
| 8 | 98.9 | 104.0 | 67.0 | na |
| 10 | 98.3 | 100.8 | 67.0 | na |
| 16 | 95.8 | 98.4 | 67.0 | na |
| 20 | 93.4 | 94.5 | 67.0 | na |
| 25 | 96.0 | 100.5 | 67.0 | na |
| 31 | 88.3 | 92.4 | 67.0 | na |
| 62 | 74.8 | 77.5 | 65.5 | na |
| 100 | 88.2 | 94.5 | 62.5 | na |
| 160 | 85.5 | 88.5 | 59.4 | na |
| 200 | 81.3 | 88.7 | 58.0 | na |
| 250 | 79.8 | 83.5 | 56.5 | na |
| 300 | 82.4 | 88.4 | 55.3 | na |
| 350 | 77.0 | 81.5 | 54.3 | na |
| 400 | 73.3 | 80.7 | 53.5 | na |
| 450 | 77.8 | 82.7 | 52.7 | na |
| 500 | 72.4 | 77.9 | 52.0 | na |
| 550 | 67.0 | 74.5 | na | na |
| 600 | 64.7 | 67.3 | na | na |
| 625 | 70.5 | 74.0 | na | na |

Fixed Tape – Incorrect tape edge location

| PSAACRF, Telecom Room side | | | Spec. TIA | |
|---|---|---|---|---|
| Freq. | Worst Case | Average | ind | Average |
| 1 | 99.1 | 102.1 | 67.0 | na |
| 4 | 102.6 | 103.2 | 66.2 | na |
| 8 | 100.9 | 102.9 | 60.1 | na |
| 10 | 99.5 | 101.5 | 58.2 | na |
| 16 | 91.3 | 95.0 | 54.1 | na |
| 20 | 92.5 | 97.7 | 52.2 | na |
| 25 | 98.5 | 110.7 | 50.2 | na |
| 31 | 89.2 | 98.3 | 48.4 | na |
| 62 | 74.7 | 78.5 | 42.4 | na |
| 100 | 88.8 | 91.3 | 38.2 | na |
| 160 | 81.9 | 86.6 | 34.1 | na |
| 200 | 78.9 | 89.0 | 32.2 | na |
| 250 | 71.4 | 76.4 | 30.2 | na |
| 300 | 76.3 | 80.5 | 28.7 | na |
| 350 | 75.0 | 79.1 | 27.3 | na |
| 400 | 66.3 | 77.1 | 26.2 | na |
| 450 | 69.5 | 77.3 | 25.1 | na |
| 500 | 70.0 | 76.6 | 24.2 | na |
| 550 | 62.6 | 66.8 | na | na |
| 600 | 59.5 | 61.8 | na | na |
| 625 | 62.2 | 64.9 | na | na |

| PSAACRF, Work Area side | | | Spec. TIA | |
|---|---|---|---|---|
| Freq. | Worst Case | Average | ind | Average |
| 1 | 97.4 | 99.0 | 67.0 | na |
| 4 | 101.5 | 104.1 | 66.2 | na |
| 8 | 101.3 | 104.2 | 60.1 | na |
| 10 | 99.2 | 106.3 | 58.2 | na |
| 16 | 96.1 | 99.3 | 54.1 | na |
| 20 | 86.6 | 91.0 | 52.2 | na |
| 25 | 100.1 | 101.8 | 50.2 | na |
| 31 | 92.2 | 96.9 | 48.4 | na |
| 62 | 77.5 | 80.0 | 42.4 | na |
| 100 | 87.3 | 89.3 | 38.2 | na |
| 160 | 85.5 | 90.2 | 34.1 | na |
| 200 | 84.7 | 88.7 | 32.2 | na |
| 250 | 72.9 | 79.5 | 30.2 | na |
| 300 | 76.0 | 83.9 | 28.7 | na |
| 350 | 73.2 | 80.4 | 27.3 | na |
| 400 | 70.6 | 76.9 | 26.2 | na |
| 450 | 73.5 | 76.3 | 25.1 | na |
| 500 | 67.6 | 74.8 | 24.2 | na |
| 550 | 61.1 | 69.1 | na | na |
| 600 | 64.4 | 66.3 | na | na |
| 625 | 59.4 | 63.4 | na | na |

Oscillating Tape

| PSANEXT, Telecom Room side | | | Spec. TIA | |
|---|---|---|---|---|
| Freq. | Worst Case | Average | ind | Average |
| 1 | 84.8 | 103.1 | 67.0 | na |
| 4 | 102.5 | 103.8 | 67.0 | na |
| 8 | 104.7 | 107.7 | 67.0 | na |
| 10 | 101.4 | 103.9 | 67.0 | na |
| 16 | 97.5 | 102.6 | 67.0 | na |
| 20 | 94.1 | 99.9 | 67.0 | na |
| 25 | 102.2 | 104.4 | 67.0 | na |
| 31 | 97.5 | 103.6 | 67.0 | na |
| 62 | 72.3 | 81.7 | 65.6 | na |
| 100 | 91.3 | 96.5 | 62.5 | na |
| 160 | 93.0 | 94.4 | 58.4 | na |
| 200 | 82.5 | 88.7 | 56.0 | na |
| 250 | 82.4 | 86.0 | 55.5 | na |
| 300 | 92.9 | 96.5 | 55.3 | na |
| 350 | 86.3 | 89.7 | 54.3 | na |
| 400 | 84.4 | 86.4 | 53.5 | na |
| 450 | 90.5 | 93.4 | 52.7 | na |
| 500 | 85.4 | 88.5 | 52.0 | na |
| 550 | 79.9 | 84.8 | na | na |
| 600 | 76.1 | 80.1 | na | na |
| 625 | 79.6 | 84.2 | na | na |

| PSANEXT, Work Area side | | | Spec. TIA | |
|---|---|---|---|---|
| Freq. | Worst Case | Average | ind | Average |
| 1 | 96.5 | 99.0 | 67.0 | na |
| 4 | 99.7 | 102.4 | 67.0 | na |
| 8 | 103.4 | 111.5 | 67.0 | na |
| 10 | 104.1 | 106.3 | 67.0 | na |
| 16 | 97.3 | 108.7 | 67.0 | na |
| 20 | 95.8 | 100.2 | 67.0 | na |
| 25 | 97.5 | 101.3 | 67.0 | na |
| 31 | 105.8 | 106.6 | 67.0 | na |
| 62 | 75.8 | 82.6 | 65.6 | na |
| 100 | 94.3 | 97.6 | 62.5 | na |
| 160 | 91.6 | 94.6 | 58.4 | na |
| 200 | 83.8 | 93.6 | 56.0 | na |
| 250 | 91.2 | 98.2 | 56.5 | na |
| 300 | 90.2 | 95.2 | 55.3 | na |
| 350 | 90.3 | 92.7 | 54.3 | na |
| 400 | 89.1 | 90.1 | 53.5 | na |
| 450 | 84.6 | 86.7 | 52.7 | na |
| 500 | 84.6 | 87.7 | 52.0 | na |
| 550 | 95.3 | 98.6 | na | na |
| 600 | 73.0 | 75.9 | na | na |
| 625 | 75.6 | 81.4 | na | na |

Oscillating Tape

| PSAACRF, Telecom Room side | | | Spec. T/A | |
|---|---|---|---|---|
| Freq. | Worst Case | Average | ind | Average |
| 1 | 101.0 | 103.1 | 57.0 | na |
| 4 | 100.7 | 102.5 | 66.2 | na |
| 8 | 98.3 | 102.0 | 60.1 | na |
| 10 | 101.2 | 107.2 | 58.2 | na |
| 16 | 100.0 | 104.2 | 54.1 | na |
| 20 | 92.1 | 95.2 | 52.2 | na |
| 25 | 98.4 | 101.3 | 50.2 | na |
| 31 | 95.1 | 103.1 | 48.4 | na |
| 62 | 73.4 | 82.9 | 42.4 | na |
| 100 | 91.6 | 94.7 | 38.2 | na |
| 160 | 89.1 | 92.1 | 34.1 | na |
| 200 | 78.6 | 84.8 | 32.2 | na |
| 250 | 89.2 | 90.8 | 30.2 | na |
| 300 | 82.2 | 89.3 | 28.7 | na |
| 350 | 80.1 | 82.3 | 27.3 | na |
| 400 | 82.9 | 85.9 | 26.2 | na |
| 450 | 82.7 | 83.8 | 25.1 | na |
| 500 | 76.0 | 79.5 | 24.2 | na |
| 550 | 75.1 | 80.9 | na | na |
| 600 | 70.7 | 78.0 | na | na |
| 625 | 72.4 | 76.4 | na | na |

| PSAACRF, Work Area side | | | Spec. T/A | |
|---|---|---|---|---|
| Freq. | Worst Case | Average | ind | Average |
| 1 | 96.6 | 99.7 | 57.0 | na |
| 4 | 99.5 | 101.6 | 66.2 | na |
| 8 | 99.5 | 101.4 | 60.1 | na |
| 10 | 103.3 | 105.2 | 58.2 | na |
| 16 | 99.9 | 105.0 | 54.1 | na |
| 20 | 94.6 | 98.7 | 52.2 | na |
| 25 | 98.1 | 103.6 | 50.2 | na |
| 31 | 95.6 | 100.3 | 48.4 | na |
| 62 | 73.4 | 81.3 | 42.4 | na |
| 100 | 92.2 | 93.1 | 38.2 | na |
| 160 | 91.8 | 92.9 | 34.1 | na |
| 200 | 79.3 | 86.7 | 32.2 | na |
| 250 | 88.7 | 94.2 | 30.2 | na |
| 300 | 87.5 | 88.8 | 28.7 | na |
| 350 | 84.9 | 87.4 | 27.3 | na |
| 400 | 81.4 | 83.9 | 26.2 | na |
| 450 | 83.7 | 86.6 | 25.1 | na |
| 500 | 82.0 | 83.6 | 24.2 | na |
| 550 | 73.5 | 78.7 | na | na |
| 600 | 67.0 | 71.6 | na | na |
| 625 | 74.4 | 79.6 | na | na |

Longitudinal Tape – Return Loss

| Pair | Range | Count | Mean | Avg Worst | Std Dev | Cpk |
|---|---|---|---|---|---|---|
| BLU, WHT/BLU | 1 - 10 | 12 | -36.105 | 8.933 | 0.5594 | 5.324 |
| BLU, WHT/BLU | 10 - 100 | 12 | -42.240 | 7.193 | 1.1428 | 2.099 |
| BLU, WHT/BLU | 100 - 240 | 12 | -37.336 | 10.605 | 0.7027 | 5.031 |
| BLU, WHT/BLU | 240 - 300 | 12 | -32.787 | 4.344 | 1.5802 | 0.916 |
| BLU, WHT/BLU | 300 - 400 | 12 | -32.754 | 10.315 | 2.2108 | 1.555 |
| BLU, WHT/BLU | 400 - 500 | 12 | -30.794 | 10.070 | 2.2402 | 1.498 |
| BLU, WHT/BLU | 500 - 625 | 12 | -28.692 | 6.061 | 2.5612 | 0.789 |
| ORG, WHT/ORG | 1 - 10 | 12 | -38.095 | 8.589 | 0.7501 | 3.817 |
| ORG, WHT/ORG | 10 - 100 | 12 | -41.094 | 6.069 | 1.1657 | 1.736 |
| ORG, WHT/ORG | 100 - 240 | 12 | -38.158 | 11.182 | 1.5560 | 2.395 |
| ORG, WHT/ORG | 240 - 300 | 12 | -38.153 | 11.642 | 1.5877 | 2.481 |
| ORG, WHT/ORG | 300 - 400 | 12 | -33.308 | 6.990 | 2.0791 | 1.121 |
| ORG, WHT/ORG | 400 - 500 | 12 | -32.216 | 9.868 | 2.7376 | 1.202 |
| ORG, WHT/ORG | 500 - 625 | 12 | -30.435 | 8.262 | 2.4583 | 1.120 |
| GRN, WHT/GRN | 1 - 10 | 12 | -34.190 | 7.488 | 0.3516 | 7.099 |
| GRN, WHT/GRN | 10 - 100 | 12 | -41.581 | 7.278 | 1.5069 | 1.610 |
| GRN, WHT/GRN | 100 - 240 | 12 | -37.481 | 11.120 | 1.6266 | 2.279 |
| GRN, WHT/GRN | 240 - 300 | 12 | -33.949 | 7.133 | 2.3590 | 1.008 |
| GRN, WHT/GRN | 300 - 400 | 12 | -32.689 | 8.888 | 2.3698 | 1.246 |
| GRN, WHT/GRN | 400 - 500 | 12 | -29.893 | 9.472 | 1.7840 | 1.770 |
| GRN, WHT/GRN | 500 - 625 | 12 | -27.772 | 7.090 | 2.0733 | 1.140 |
| BRN, WHT/BRN | 1 - 10 | 12 | -35.447 | 8.037 | 0.5842 | 4.586 |
| BRN, WHT/BRN | 10 - 100 | 12 | -41.343 | 5.648 | 1.5514 | 1.133 |
| BRN, WHT/BRN | 100 - 240 | 12 | -38.587 | 12.128 | 1.9154 | 2.111 |
| BRN, WHT/BRN | 240 - 300 | 12 | -34.810 | 11.103 | 2.1350 | 1.733 |
| BRN, WHT/BRN | 300 - 400 | 12 | -32.822 | 6.444 | 1.4638 | 1.467 |
| BRN, WHT/BRN | 400 - 500 | 12 | -31.224 | 9.900 | 2.5921 | 1.141 |
| BRN, WHT/BRN | 500 - 625 | 12 | -29.300 | 8.000 | 2.0974 | 1.271 |

*FIG. 9A*

Spiral Tape – Return Loss

| Pair | Range | Count | Mean | Avg Worst | Std Dev | Cpk |
|---|---|---|---|---|---|---|
| BLU, WHT/BLU | 1 - 10 | 8 | -32.881 | 5.356 | 0.6394 | 2.793 |
| BLU, WHT/BLU | 1 - 625 | 8 | -29.545 | 3.839 | 0.7560 | 1.686 |
| BLU, WHT/BLU | 10 - 100 | 8 | -38.871 | 5.008 | 1.6833 | 0.992 |
| BLU, WHT/BLU | 100 - 240 | 8 | -33.148 | 7.037 | 0.7267 | 3.228 |
| BLU, WHT/BLU | 240 - 300 | 8 | -29.315 | 7.668 | 1.4065 | 1.617 |
| BLU, WHT/BLU | 300 - 400 | 8 | -27.253 | 6.255 | 1.8031 | 1.156 |
| BLU, WHT/BLU | 400 - 500 | 8 | -25.552 | 5.475 | 0.5698 | 3.094 |
| BLU, WHT/BLU | 500 - 625 | 8 | -23.702 | 3.982 | 0.9191 | 1.444 |
| ORG, WHT/ORG | 1 - 10 | 8 | -35.322 | 7.062 | 0.9607 | 2.450 |
| ORG, WHT/ORG | 1 - 625 | 8 | -30.264 | 4.439 | 1.5146 | 0.977 |
| ORG, WHT/ORG | 10 - 100 | 8 | -39.812 | 6.291 | 2.2334 | 0.939 |
| ORG, WHT/ORG | 100 - 240 | 8 | -34.255 | 9.223 | 1.1391 | 2.699 |
| ORG, WHT/ORG | 240 - 300 | 8 | -29.879 | 8.073 | 1.1120 | 2.420 |
| ORG, WHT/ORG | 300 - 400 | 8 | -27.329 | 6.227 | 0.5574 | 3.723 |
| ORG, WHT/ORG | 400 - 500 | 8 | -26.080 | 5.994 | 1.7818 | 1.121 |
| ORG, WHT/ORG | 500 - 625 | 8 | -24.436 | 4.953 | 1.5299 | 1.079 |
| GRN, WHT/GRN | 1 - 10 | 8 | -33.222 | 5.371 | 0.5978 | 2.995 |
| GRN, WHT/GRN | 1 - 625 | 8 | -29.512 | 3.182 | 1.0299 | 1.030 |
| GRN, WHT/GRN | 10 - 100 | 8 | -36.871 | 3.246 | 1.0989 | 0.985 |
| GRN, WHT/GRN | 100 - 240 | 8 | -32.607 | 6.560 | 1.1073 | 1.975 |
| GRN, WHT/GRN | 240 - 300 | 8 | -30.202 | 7.412 | 1.0690 | 2.311 |
| GRN, WHT/GRN | 300 - 400 | 8 | -27.193 | 6.619 | 0.9032 | 2.443 |
| GRN, WHT/GRN | 400 - 500 | 8 | -25.976 | 6.159 | 1.3059 | 1.572 |
| GRN, WHT/GRN | 500 - 625 | 8 | -24.834 | 5.450 | 1.5864 | 1.145 |
| BRN, WHT/BRN | 1 - 10 | 8 | -34.467 | 6.455 | 0.4463 | 4.800 |
| BRN, WHT/BRN | 1 - 625 | 8 | -29.278 | 1.595 | 1.2267 | 0.433 |
| BRN, WHT/BRN | 10 - 100 | 8 | -36.960 | 1.864 | 1.4898 | 0.417 |
| BRN, WHT/BRN | 100 - 240 | 8 | -31.681 | 4.207 | 1.3275 | 1.056 |
| BRN, WHT/BRN | 240 - 300 | 8 | -29.166 | 4.684 | 1.9992 | 0.781 |
| BRN, WHT/BRN | 300 - 400 | 8 | -27.496 | 4.154 | 1.4697 | 0.942 |
| BRN, WHT/BRN | 400 - 500 | 8 | -26.065 | 3.930 | 1.5567 | 0.842 |
| BRN, WHT/BRN | 500 - 625 | 8 | -24.730 | 3.763 | 1.1524 | 1.094 |

FIG. 9B

Oscillating Tape – Return Loss

| Pair | Range | Count | Mean | Avg Worst | Std Dev | Cpk |
|---|---|---|---|---|---|---|
| BLU, WHT/BLU | 1 - 10 | 30 | -31.825 | 4.838 | 0.3465 | 4.654 |
| BLU, WHT/BLU | 1 - 625 | 30 | -31.616 | 4.193 | 1.1044 | 1.266 |
| BLU, WHT/BLU | 10 - 100 | 30 | -35.900 | 5.842 | 0.6420 | 3.033 |
| BLU, WHT/BLU | 100 - 240 | 30 | -35.069 | 8.246 | 1.3199 | 2.082 |
| BLU, WHT/BLU | 240 - 300 | 30 | -31.999 | 9.008 | 1.4056 | 2.136 |
| BLU, WHT/BLU | 300 - 400 | 30 | -30.686 | 8.409 | 1.2900 | 2.173 |
| BLU, WHT/BLU | 400 - 550 | 30 | -28.706 | 7.870 | 1.3249 | 1.980 |
| BLU, WHT/BLU | 550 - 625 | 30 | -26.734 | 5.217 | 1.9944 | 0.872 |
| ORG, WHT/ORG | 1 - 10 | 30 | -35.552 | 7.016 | 0.4113 | 5.685 |
| ORG, WHT/ORG | 1 - 625 | 30 | -32.803 | 6.347 | 0.6360 | 3.327 |
| ORG, WHT/ORG | 10 - 100 | 30 | -40.007 | 8.290 | 1.3195 | 2.094 |
| ORG, WHT/ORG | 100 - 240 | 30 | -36.156 | 8.868 | 1.3394 | 2.207 |
| ORG, WHT/ORG | 240 - 300 | 30 | -32.155 | 8.330 | 1.4818 | 1.874 |
| ORG, WHT/ORG | 300 - 400 | 30 | -31.138 | 7.928 | 1.1752 | 2.249 |
| ORG, WHT/ORG | 400 - 550 | 30 | -28.934 | 7.644 | 1.3489 | 1.889 |
| ORG, WHT/ORG | 550 - 625 | 30 | -28.018 | 7.915 | 1.3456 | 1.961 |
| GRN, WHT/GRN | 1 - 10 | 30 | -31.989 | 5.029 | 0.2695 | 6.219 |
| GRN, WHT/GRN | 1 - 625 | 30 | -31.564 | 4.929 | 0.3010 | 5.458 |
| GRN, WHT/GRN | 10 - 100 | 30 | -36.809 | 6.698 | 0.5825 | 3.833 |
| GRN, WHT/GRN | 100 - 240 | 30 | -35.320 | 8.348 | 1.0680 | 2.605 |
| GRN, WHT/GRN | 240 - 300 | 30 | -31.900 | 8.556 | 1.3978 | 2.040 |
| GRN, WHT/GRN | 300 - 400 | 30 | -30.082 | 7.969 | 1.5112 | 1.758 |
| GRN, WHT/GRN | 400 - 550 | 30 | -28.171 | 7.496 | 1.2895 | 1.938 |
| GRN, WHT/GRN | 550 - 625 | 30 | -26.675 | 6.267 | 1.1935 | 1.750 |
| BRN, WHT/BRN | 1 - 10 | 30 | -36.179 | 7.959 | 0.4642 | 5.715 |
| BRN, WHT/BRN | 1 - 625 | 30 | -33.068 | 6.637 | 1.1073 | 1.998 |
| BRN, WHT/BRN | 10 - 100 | 30 | -39.773 | 8.022 | 1.4087 | 1.898 |
| BRN, WHT/BRN | 100 - 240 | 30 | -36.208 | 9.093 | 1.1566 | 2.621 |
| BRN, WHT/BRN | 240 - 300 | 30 | -32.147 | 9.072 | 1.3717 | 2.204 |
| BRN, WHT/BRN | 300 - 400 | 30 | -31.462 | 9.016 | 1.9575 | 1.535 |
| BRN, WHT/BRN | 400 - 550 | 30 | -29.899 | 7.900 | 1.5967 | 1.649 |
| BRN, WHT/BRN | 550 - 625 | 30 | -27.982 | 8.200 | 1.6294 | 1.678 |

FIG. 9C

HIGH PERFORMANCE DATA COMMUNICATIONS CABLE

RELATED APPLICATIONS

The present application claims the benefit of and priority as a continuation to U.S. Nonprovisional application Ser. No. 15/996,161, entitled "Improved High Performance Data Communications Cable," filed Jun. 1, 2018; which claims priority as a continuation to U.S. Nonprovisional application Ser. No. 15/610,504, entitled "Improved High Performance Data Communications Cable," filed May 31, 2017; which claims priority as a continuation to U.S. Nonprovisional application Ser. No. 14/520,125, entitled "Improved High Performance Data Communications Cable," filed Oct. 21, 2014; which claims priority to U.S. Provisional Application No. 61/894,728, entitled "Improved High Performance Data Communications Cable," filed Oct. 23, 2013, the entirety of each of which are hereby incorporated by reference.

FIELD

The present application relates to data cables. In particular, the present application relates to a filler for controlled placement of pairs of conductors within a data cable and controlled application angle of an electromagnetic interference (EMI) reducing tape.

BACKGROUND

High-bandwidth data cable standards established by industry standards organizations including the Telecommunications Industry Association (TIA), International Organization for Standardization (ISO), and the American National Standards Institute (ANSI) such as ANSI/TIA-568-C.2, include performance requirements for cables commonly referred to as Category 6A type. These high performance Category 6A cables have strict specifications for maximum return loss and crosstalk, amongst other electrical performance parameters. Failure to meet these requirements means that the cable may not be usable for high data rate communications such as 1000BASE-T (Gigabit Ethernet), 10GBASE-T (10-Gigabit Ethernet), or other future emerging standards.

Crosstalk is the result of electromagnetic interference (EMI) between adjacent pairs of conductors in a cable, whereby signal flow in a first twisted pair of conductors in a multi-pair cable generates an electromagnetic field that is received by a second twisted pair of conductors in the cable and converted back to an electrical signal. Similarly, alien crosstalk is electromagnetic interference between adjacent cables. In typical installations with a large number of cables following parallel paths from switches and routers through cable ladders and trays, many cables with discrete signals may be in close proximity and parallel for long distances, increasing alien crosstalk. Alien crosstalk is frequently measured via two methods: power sum alien near end crosstalk (PSANEXT) is a measurement of interference generated in a test cable by a number of surrounding interfering or "disturbing" cables, typically six, and is measured at the same end of the cable as the interfering transmitter; and power sum alien attenuation to crosstalk ratio, far-end (PSAACRF), which is a ratio of signal attenuation due to resistance and impedance of the conductor pairs, and interference from surrounding disturbing cables.

Return loss is a measurement of a difference between the power of a transmitted signal and the power of the signal reflections caused by variations in impedance of the conductor pairs. Any random or periodic change in impedance in a conductor pair, caused by factors such as the cable manufacturing process, cable termination at the far end, damage due to tight bends during installation, tight plastic cable ties squeezing pairs of conductors together, or spots of moisture within or around the cable, will cause part of a transmitted signal to be reflected back to the source.

Typical methods for addressing alien and internal crosstalk have tradeoffs. For example, alien crosstalk may be reduced by increasing the size of the cable, adding weight and volume and reducing the number of cables that may be placed in a cable tray. Other cables have implemented complex discontinuous EMI barriers and tapes in an attempt to control alien crosstalk and ground current disruption, but add significant expense and may actually increase alien crosstalk in some implementations. Fully shielded cables, such as foil over unshielded twisted pair (F/UTP) designs include drain wires for grounding a conductive foil shield, but are significantly more expensive in total installed cost with the use of shielded connectors and other related hardware. Fully shielded cables are also more difficult to terminate and may induce ground loop currents and noise if improperly terminated.

SUMMARY

The present disclosure describes methods of manufacture and implementations of unshielded twisted pair (UTP) cables with a barrier tape, which may be conductive or partially conductive, with reduced alien crosstalk and return loss without increased material expense, via control of application angle of the barrier tape around helically arranged twisted pairs of conductors. A filler is included within the cable to separate the twisted pairs and provide a support base for the barrier tape, allowing a cylindrical shape for the cable for optimized ground plane uniformity and stability for improved impedance and return loss performance. The filler also provides an air insulating layer above the pairs and under the barrier tape as needed without requiring an inner jacket between the pairs and tape, potentially removing a costly manufacturing step.

In a first implementation, referred to herein as fixed tape control (FTC), an angle of application of the barrier tape is configured to match a helical twist angle of the cable, and edges of the barrier tape are precisely placed on terminal portions of arms of the filler. Accordingly, the tape edges do not fall on top of or periodically cross over the pairs of conductors as in typical helical, spiral, or longitudinal tape application methodologies, eliminating impedance discontinuities that cause return losses and preventing EMI coupling at tape edges that increase alien crosstalk.

In a second implementation, referred to herein as oscillating tape control (OTC), the angle of application of the barrier tape is continuously varied across a predetermined range. Edges of the barrier tape cross all of the conductor pairs, but at varying periodicity, with the tape edge not consistently proximate to a given pair in the cable. While OTC implementations may have increased alien crosstalk compared to FTC implementations, no one pair is adversely affected more than the others due to consistent proximity to the tape edge. Furthermore, because application angles and placement need not be precise, manufacturing complexity and expense is greatly reduced.

In one aspect, the present disclosure is directed to a fixed tape control high performance data cable. The cable includes a plurality of twisted pairs of insulated conductors, and a filler comprising a plurality of arms separating each twisted pair of insulated conductors, each arm having a terminal portion. The cable also includes a conductive barrier tape surrounding the filler and plurality of twisted pairs of insulated conductors. In some implementations, the cable further includes a jacket surrounding the conductive barrier tape. The filler is configured in a helical twist at a first angle, the conductive barrier tape is configured in a helical twist at the first angle, and a seam of the conductive barrier tape is positioned above a terminal portion of an arm of the filler.

In one implementation of the cable, a second seam of the conductive barrier tape is positioned above a terminal portion of a second arm of the filler, the second seam overlapping a portion of the conductive barrier tape. In another implementation of the cable, the seam of the conductive barrier tape is approximately centered above the terminal portion of the arm of the filler. In still another implementation of the cable, the filler has four arms and a cross-shaped cross section. In another implementation of the cable, each twisted pair of insulated conductors is positioned in the center of a channel formed by two adjacent arms and corresponding terminal portions of the filler. In yet another implementation of the cable, the barrier tape comprises a conductive material contained between two layers of a dielectric material.

In another aspect, the present disclosure is directed to an oscillating tape control high performance data cable. The cable includes a plurality of twisted pairs of insulated conductors. In some implementations, the cable includes a filler comprising one or more arms separating adjacent twisted pairs of insulated conductors, each arm having a terminal portion. The cable also includes a conductive barrier tape surrounding the filler and plurality of twisted pairs of insulated conductors. In other implementations, the cable does not include a filler. In some implementations, the cable includes a jacket surrounding the conductive barrier tape. The filler and/or twisted pairs are configured in a helical twist at a first angle; and the conductive barrier tape is configured in a helical twist at an application angle varying between a second angle and a third angle.

In some implementations of the cable, the second angle comprises the first angle minus a predetermined value and the third angle comprises the first angle plus the predetermined value. In other implementations of the cable, the application angle varies from the second angle and the third angle along a length of the cable longer than a length of one helical twist of the filler. In still other implementations of the cable, a position of a first seam of the conductive barrier tape varies from a first position above a first channel formed by two adjacent arms and corresponding terminal portions of the filler, to a second position over a terminal portion of a first arm of said adjacent arms. In a further implementation of the cable, the position of the first seam further varies to a third position over a second channel formed by the first arm of said adjacent arms and a third arm and corresponding terminal portions of the filler. In another implementation of the cable, the filler has four arms and a cross-shaped cross section. In still another implementation of the cable, each twisted pair of insulated conductors is positioned in the center of a channel formed by two adjacent arms and corresponding terminal portions of the filler. In yet another implementation of the cable, the barrier tape comprises a conductive material contained between two layers of a dielectric material.

In still another aspect, the present disclosure is directed to a method of manufacture of a high performance data cable. In some implementations, the method includes positioning a filler comprising one or more arms, each arm having a terminal portion. In some implementations, the method also includes positioning at least one pair of a plurality of twisted pairs of insulated conductors within a channel formed by adjacent arms of the filler and corresponding terminal portions. In other implementations, the method includes separating pairs of the plurality of twisted pairs of insulated conductors with a filler including at least one arm. The method further includes helically twisting the filler and plurality of twisted pairs at a first angle. The method also includes wrapping the helically twisted filler and plurality of twisted pairs with a conductive barrier tape at an application angle. In some implementations, the method also includes jacketing the barrier tape and helically twisted filler and plurality of twisted pairs.

In one implementation of the method, the application angle is equal to the first angle, and the method includes positioning a first seam of the conductive barrier tape above a terminal portion of an arm of the filler. In a further implementation, the method includes positioning a second seam of the conductive barrier tape above a terminal portion of a second, adjacent arm of the filler, the second seam overlapping a portion of the conductive barrier tape.

In another implementation, the method includes varying the application angle between a second angle and a third angle. In a further implementation, the second angle comprises the first angle minus a predetermined value and the third angle comprises the first angle plus the predetermined value. In another further implementation, the method includes positioning a feed of the conductive barrier tape tangent to a roller; and moving the roller bidirectionally along a track in a direction at an angle to the length of the cable.

BRIEF DESCRIPTION OF THE FIGURES

FIGS. 9A-9C are tables of measured return loss for embodiments of UTP cables with a longitudinally applied barrier tape, a helically applied barrier tape, and an OTC method applied barrier tape, respectively.

In the drawings, like reference numbers generally indicate identical, functionally similar, and/or structurally similar elements.

Figure 1:
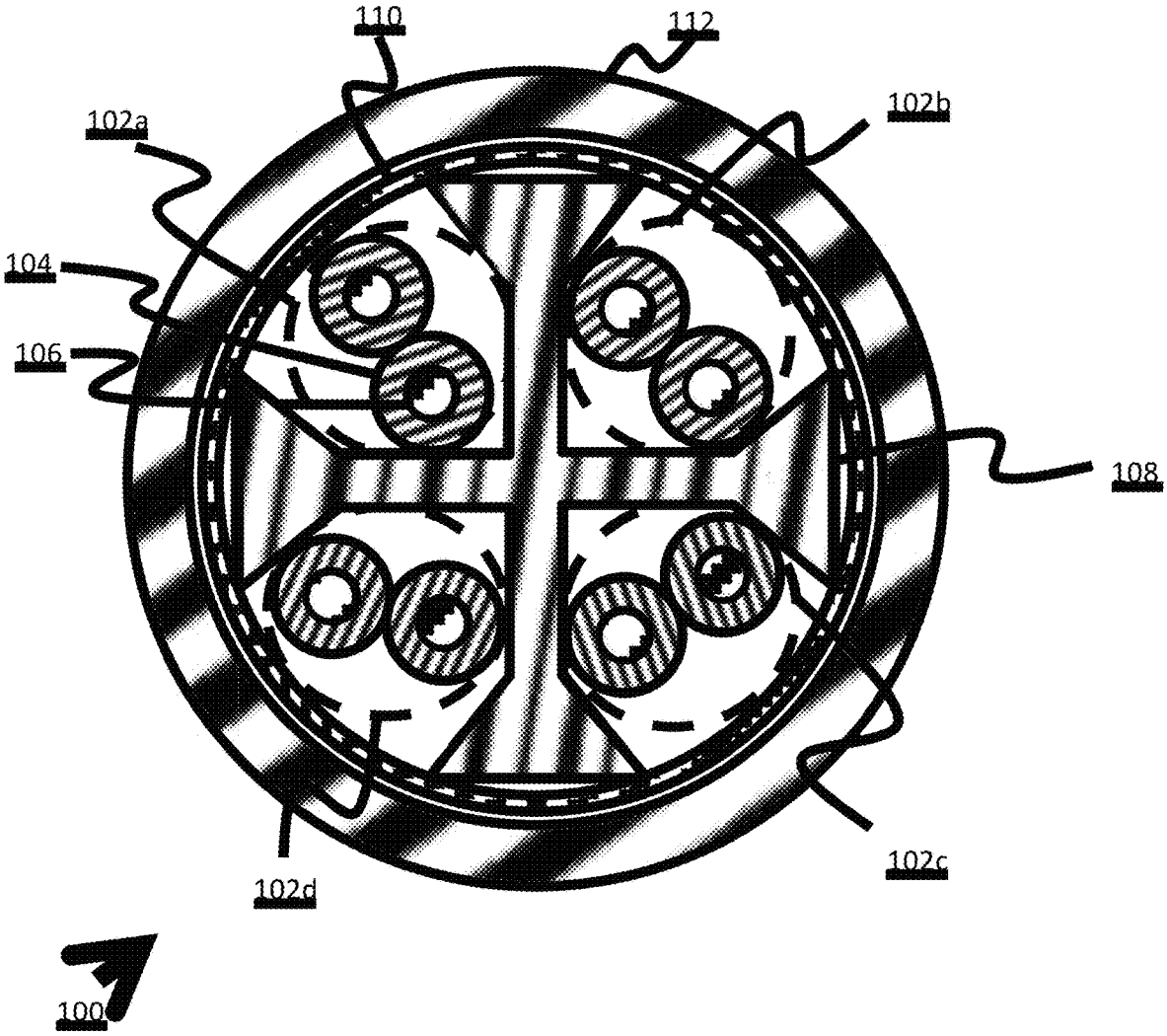
FIG. 1 is a cross section of an embodiment of a UTP cable incorporating a filler.

The patent or application file contains at least one drawing executed in color. Copies of this patent or patent application publication with color drawings will be provided by the Office upon request and payment of the necessary fee.

DETAILED DESCRIPTION

The present disclosure addresses problems of cable to cable or "alien" crosstalk (ANEXT) and signal Return Loss (RL) in a cost effective manner, without the larger, stiffer, more expensive, and harder to consistently manufacture design tradeoffs of typical cables. In particular, the methods of manufacture and cables disclosed herein reduce internal cable RL and external cable ANEXT coupling noise, meeting American National Standards Institute (ANSI)/Telecommunications Industry Association (TIA) 568 Category 6A (Category 6 Augmented) specifications via two tape application design methodologies.

First, in one embodiment, a Fixed Tape Control (FTC) process helically applies a barrier tape around a cable comprising pairs of unshielded twisted pair (UTP) conductors with a filler ensuring dimensional stability for improved internal cable electrical performance. The FTC process precisely controls the placement and angle of the barrier tape edge on a terminal portion of the filler, sometimes referred to as an anvil, "T-top", or arm end, such that the tape edge has little variation from that location and does not fall on top of or periodically cross over the pairs. The consistency of the tape's edge improves RL, and the location of the tape edge manages ANEXT.

Second, in another embodiment, an Oscillating Tape Control (OTC) process helically applies a barrier tape around the cable with a continuously varying angle. In this process, the barrier tape edge crosses all of the pairs of conductors of the cable with varying periodicity, with slightly increased RL compared to the FTC process as a compromise for less precise tooling, less cabling machine operator experience and expertise, less set up variation and risk, and consequently lower overall complexity and expense.

Accordingly, these two tape application methods either vary the location of the tape edge such that coupling from the pairs to the tape edge is reduced as the tape edge doesn't periodically cross the pairs (as occurs with a typical longitudinal or spirally applied tape) resulting in increased RL, or a typical helically applied tape that follows the stranding lay of the cable where the tape edge can consistently be proximate a given pair in the cable, causing excessive coupling of signals of the given pair to the tape edge and resulting in unacceptable levels of ANEXT in the cable.

In some embodiments, the barrier tape may comprise an electrically continuous electromagnetic interference (EMI) barrier tape, used to mitigate ground interference in the design. In one embodiment, the tape has three layers in a dielectric/conductive/dielectric configuration, such as polyester (PET)/Aluminum foil/polyester (PET). In some embodiments, the tape may not include a drain wire and may be left unterminated or not grounded during installation.

The filler may have a cross-shaped cross section and be centrally located within the cable, with pairs of conductors in channels between each arm of the cross. At each end of the cross, in some embodiments, an enlarged terminal portion of the filler may provide structural support to the barrier tape and allow the FTC process to locate the tape edge above the filler, rather than a pair of conductors. The filler allows a cylindrical shape for optimized ground plane uniformity and stability for improved impedance/RL performance.

Referring first to FIG. 1, illustrated is a cross section of an embodiment of a UTP cable 100 incorporating a filler 108. The cable includes a plurality of unshielded twisted pairs 102*a*-102*d* (referred to generally as pairs 102) of individual conductors 106 having insulation 104. Conductors 106 may be of any conductive material, such as copper or oxygen-free copper (i.e. having a level of oxygen of 0.001% or less) or any other suitable material, including Ohno Continuous Casting (OCC) copper or silver. Conductor insulation 104 may comprise any type or form of insulation, including fluorinated ethylene propylene (FEP) or polytetrafluoroethylene (PTFE) Teflon®, high density polyethylene (HDPE), low density polyethylene (LDPE), polypropylene (PP), or any other type of low dielectric loss insulation. The insulation around each conductor 201 may have a low dielectric constant (e.g. 1-3) relative to air, reducing capacitance between conductors. The insulation may also have a high dielectric strength, such as 400-4000 V/mil, allowing thinner walls to reduce inductance by reducing the distance between the conductors. In some embodiments, each pair 102 may have a different degree of twist or lay (i.e. the distance required for the two conductors to make one 360-degree revolution of a twist), reducing coupling between pairs. In other embodiments, two pairs may have a longer lay (such as two opposite pairs 102*a*, 102*c*), while two other pairs have a shorter lay (such as two opposite pairs 102*b*, 102*d*). Each pair 102 may be placed within a channel between two arms of a filler 108, said channel sometimes referred to as a groove, void, region, or other similar identifier.

Figure 2A:
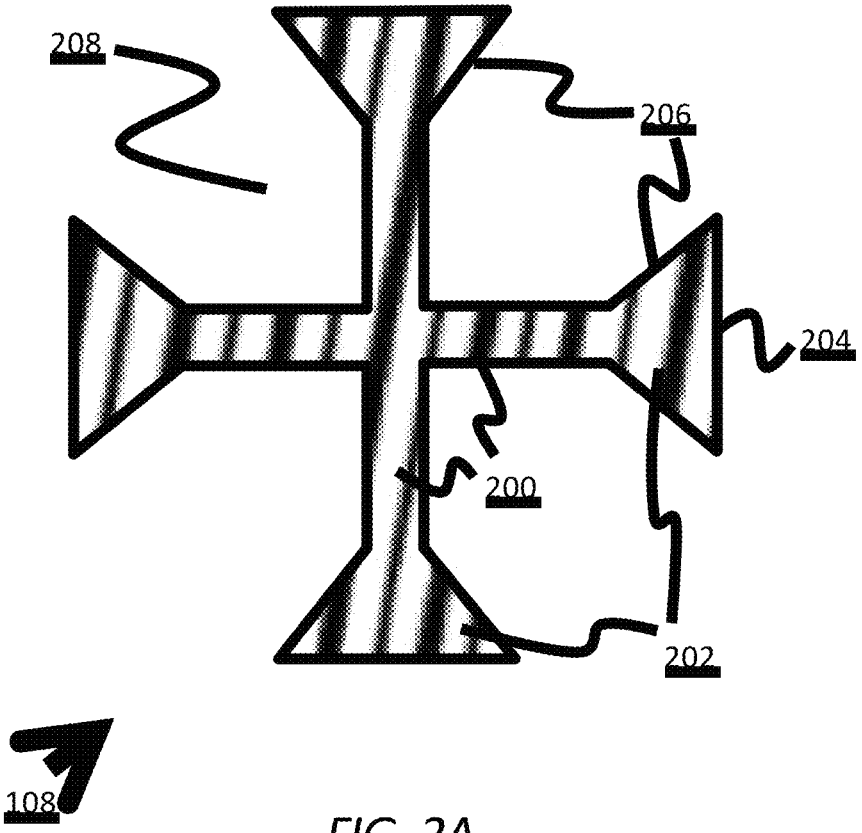
FIG. 2A is a cross section of an embodiment of the filler of FIG. 1.

In some embodiments, cable 100 may include a filler 108. Filler 108 may be of a non-conductive material such as flame retardant polyethylene (FRPE) or any other such low loss dielectric material. Referring ahead to FIG. 2A, illustrated is a cross section of an embodiment of the filler 108 of FIG. 1. As shown, filler 108 may have a cross-shaped cross section with arms 200 radiating from a central point and having a terminal portion 202 having end surfaces 204 and sides 206. Each terminal portion 202 may be anvil-shaped, rounded, square, T-shaped, or otherwise shaped. Each arm 200 and terminal portion 202 may surround a channel 208, separating pairs of conductors 102 and providing structural stability to cable 100. Filler 108 may be of any size, depending on the diameter of pairs 102. For example, in one embodiment of a cable with an outer diameter of approximately 0.275", the filler may have a terminal portion edge to edge measurement of approximately 0.235". Although shown symmetric, in some embodiments, the terminal portions 202 may have asymmetric profiles. Similarly, although shown flat, in some embodiments end surfaces 204 may be curved to match an inner surface of a circular jacket of cable 100.

Figure 2B:
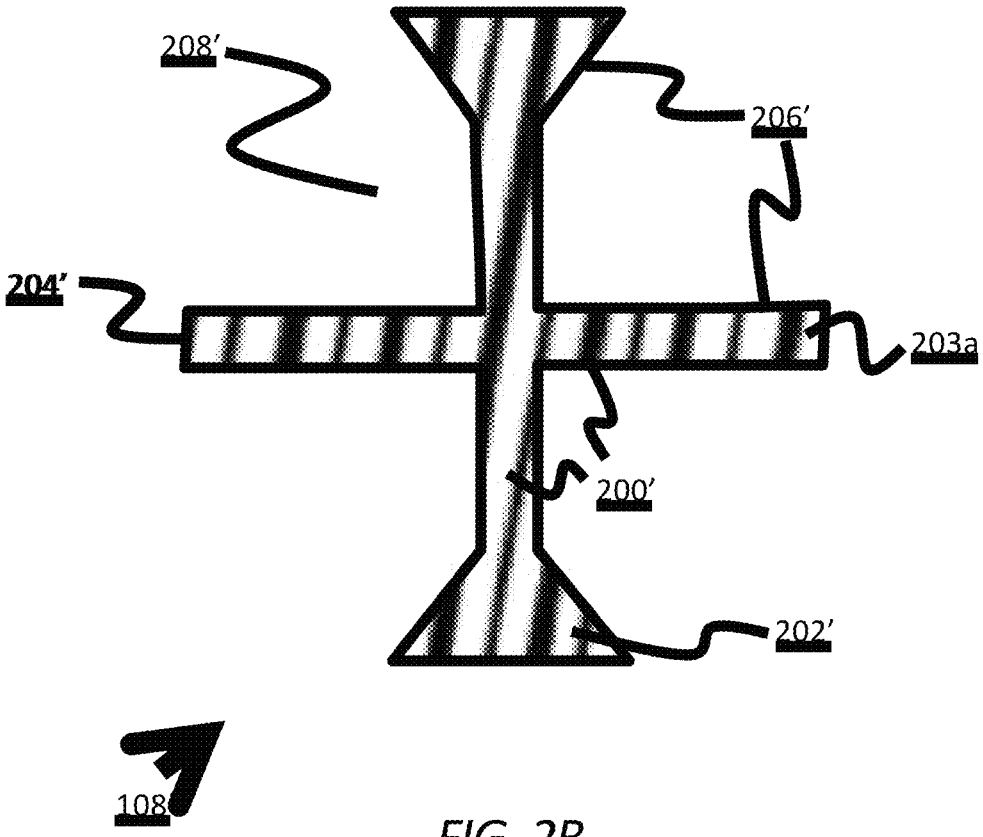
FIG. 2B is a cross section of another embodiment of a filler.

FIG. 2B is a cross-section of another embodiment of a filler 108'. Terminal portions of each arm 200' need not be identical: in the embodiment shown, two arms end in blunt portions 203*a* similar in size and shape to the arm, with sides 206' and end surfaces 204', while two arms end in anvil shaped portions 202'. As with the embodiment of FIG. 2A, each adjacent arm 200' and terminal portions 202', 203*a* surround a channel 208'.

Figure 2C:
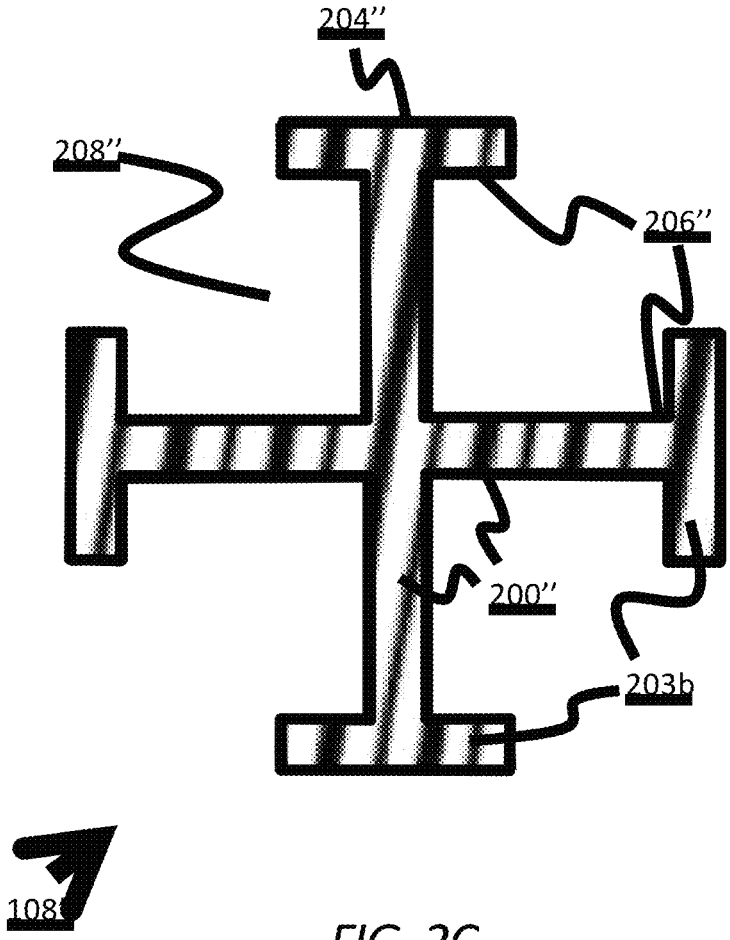
FIG. 2C is a cross section of still another embodiment of a filler.

FIG. 2C is a cross-section of another embodiment of a filer 108". In the embodiment illustrated, terminal portions 203*b* of each arm are T-shaped, with flat ends 204" and sides 206". In other embodiments, as discussed above, ends 204" may be curved to match an inner surface of a circular jacket of a cable. Each adjacent arm 200" and terminal portions 203*b* surround a channel 208".

Figure 2E:
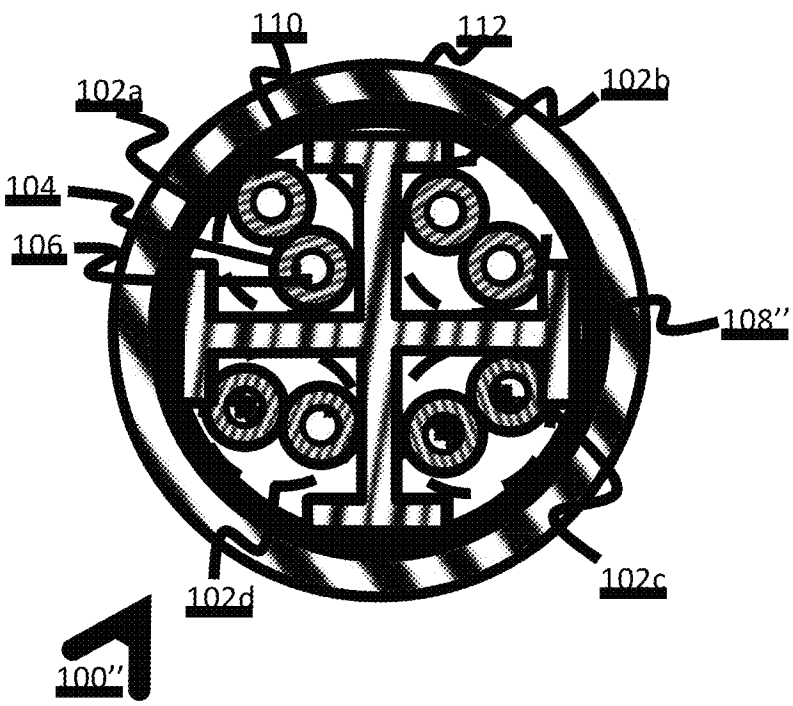
FIG. 2E is a cross section of an embodiment of a UTP cable incorporating an embodiment of the filler of FIG. 2C.
Figure 2D:
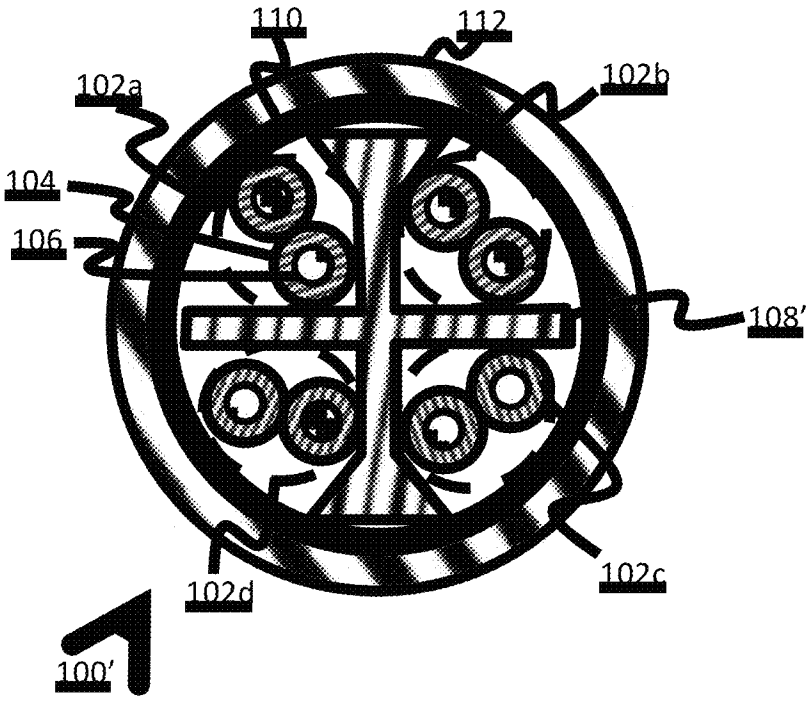
FIG. 2D is a cross section of an embodiment of a UTP cable incorporating an embodiment of the filler of FIG. 2B.

FIG. 2D is a cross section of an embodiment of a UTP cable 100' incorporating a filler 108' as shown in FIG. 2B. Similarly, FIG. 2E is a cross section of an embodiment of a UTP cable 100" incorporating a filler 108" as shown in FIG. 2C. Other portions of cables 100' and 100", such as conductors, barriers, and jackets may be identical to those described above in connection with FIG. 1.

In another embodiment not illustrated, some arms may have a T-shaped terminal portion 203*b*, while other arms have a blunt portion 203*a*, an anvil shaped portion 202, or any other such shape. Although FIGS. 2A-2C are shown with fillers having four arms, in other embodiments, a filler may have other numbers of arms, including two arms, three arms, five arms, six arms, etc.

Figure 3A:
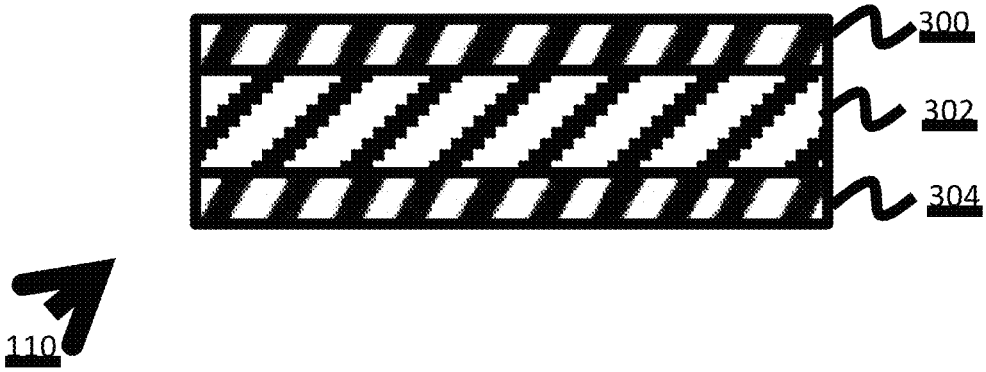
FIG. 3A is a cross section of an embodiment of a barrier tape.

Returning to FIG. 1, in some embodiments, cable 100 may include a conductive barrier tape 110 surrounding filler 108 and pairs 102. The conductive barrier tape 110 may comprise a continuously conductive tape, a discontinuously conductive tape, a foil, a dielectric material, a combination of a foil and dielectric material, or any other such materials. For example, and referring ahead briefly to FIG. 3A, illustrated is a cross section of an embodiment of a barrier tape 110 having a multi-layer configuration (the illustration may not be to scale, with the central portion narrower or thicker in various embodiments). In the embodiment illustrated, a conductive material 302, such as aluminum foil, is located or contained between two layers of a dielectric material 300, 304, such as polyester (PET). Intermediate adhesive layers (not illustrated) may be included. In some embodiments, a conductive carbon nanotube layer may be used for improved electrical performance and flame resistance with reduced size. Although shown edge to edge, in some embodiments, the conductive layer 302 may not extend to the edge of the tape 110. In such embodiments, the dielectric layers 300, 304 may completely encapsulate the conductive layer 302. In a similar embodiment, edges of the tape may include folds back over themselves.

Returning to FIG. 1, the cable 100 may include a jacket 112 surrounding the barrier tape 110, filler 108, and/or pairs 102. Jacket 112 may comprise any type and form of jacketing material, such as polyvinyl chloride (PVC), fluorinated ethylene propylene (FEP) or polytetrafluoroethylene (PTFE) Teflon®, high density polyethylene (HDPE), low density polyethylene (LDPE), or any other type of jacket material. In some embodiments, jacket 112 may be designed to produce a plenum- or riser-rated cable.

Figure 3B:
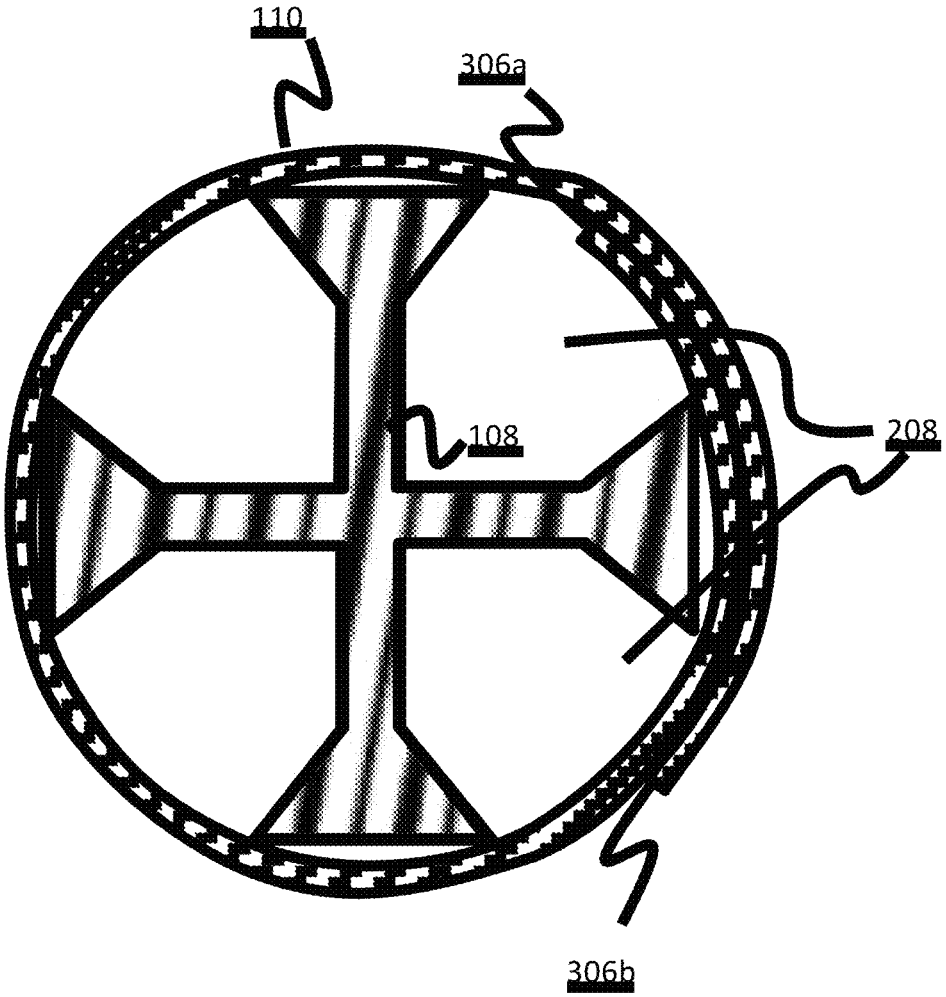
FIG. 3B is a cross section of an embodiment of a barrier tape around the filler of FIG. 2A showing improper placement above a pair channel.
Figure 3C:
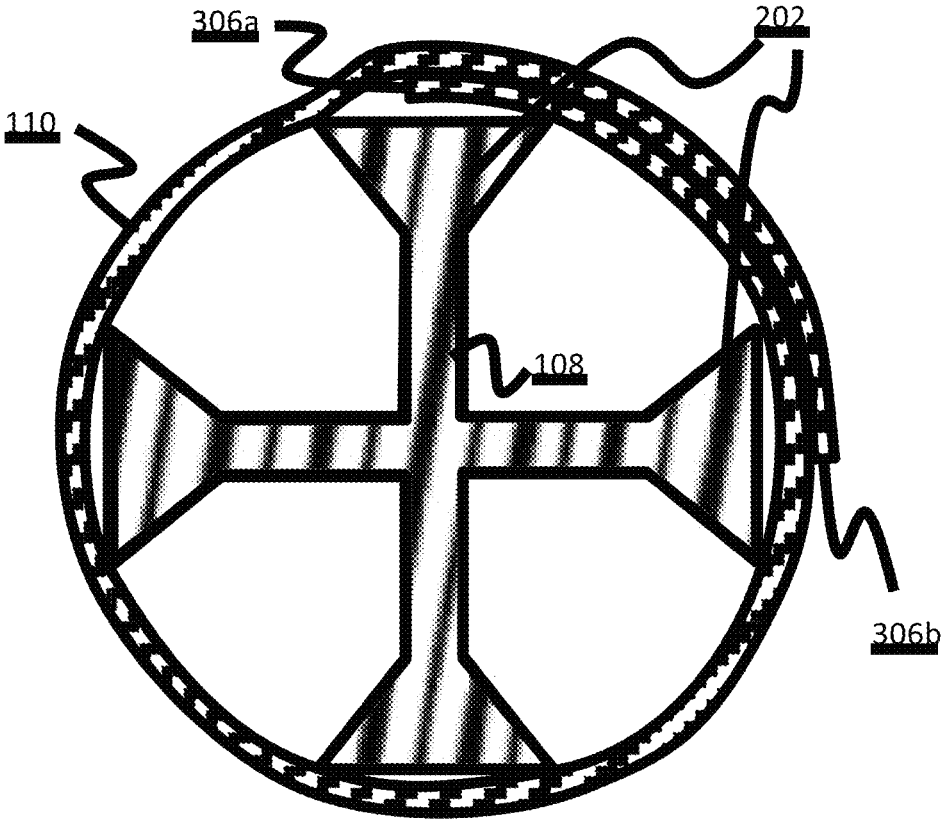
FIG. 3C is a cross section of an embodiment of a barrier tape around the filler of FIG. 2A showing proper placement above filler terminal portions.
Figure 3D:
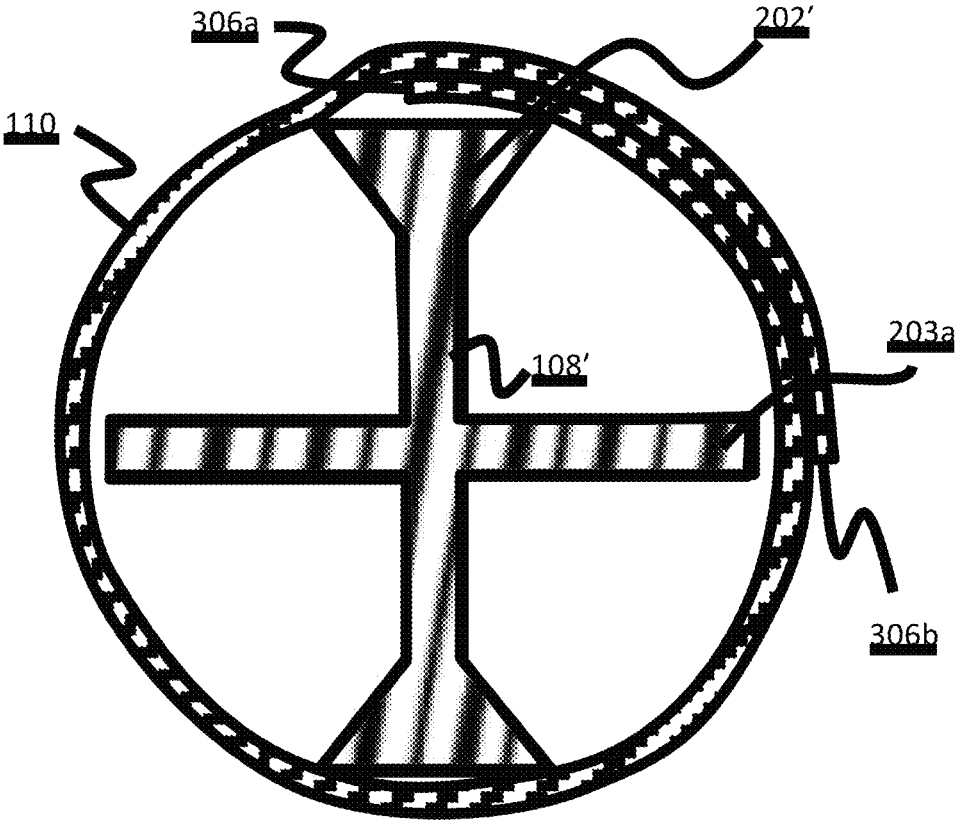
FIG. 3D is a cross section of an embodiment of a barrier tape around the filler of FIG. 2B showing proper placement above filler terminal portions.

Although shown for simplicity in FIG. 1 as a continuous ring, barrier tape 110 may comprise a flat tape material applied around filler 108 and pairs 102. Referring now to FIG. 3B, illustrated is a cross section of an embodiment of a barrier tape 110 around the filler 108 of FIG. 2A. The tape 110 has a first edge 306*a* and a second edge 306*b*, referred to generally as edge(s) 306 of the barrier tape 110. In the embodiment illustrated in FIG. 3B, the edges 306*a* and 306*b* lie above channels 208. Pairs 102 within said voids could electrically couple to the corresponding edge 306, resulting in increased ANEXT. By contrast, FIG. 3C is a cross section of an embodiment of a barrier tape 110 around the filler 108 of FIG. 2A showing proper placement above filler terminal portions 202. In this configuration, edges 306 of the tape 110 are as far as possible from any channel 208 and corresponding pair 102. As shown, in some embodiments, barrier tape 110 may have sufficient width such that a first edge 306*a* is above a first terminal portion 202 and a second edge 306*b* is above a second terminal portion 202. This allows for 90 degrees of overlap of the tape 110, preventing leakage, while placing both edges 306 above terminal portions 202. In other embodiments, barrier tape 110 may overlap by 180 degrees, 270 degrees, or any other value, including values such that one edge may land on a channel. FIG. 3D is another cross section of an embodiment of a barrier tape 110 around an embodiment of a filler 108', such as that shown in FIG. 2B. As shown, edges 306*a*, 306*b* of a barrier tape 110 may be positioned above a terminal portion 202', 203*a* of the filler 108'.

Figure 3E:
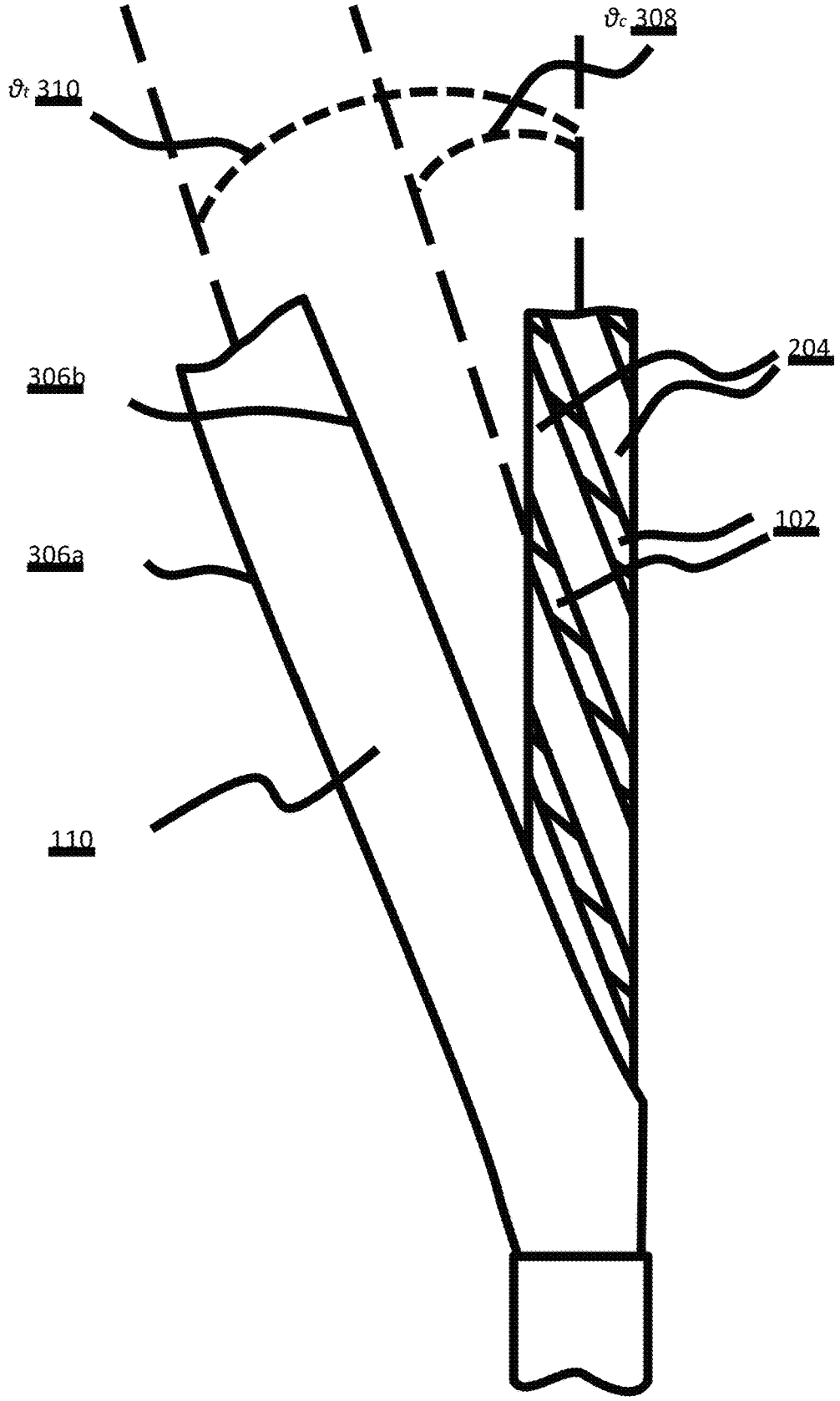
FIG. 3E is a top view of an embodiment of fixed tape control installation of a barrier tape on a UTP cable incorporating a filler.

Referring now to FIG. 3E, illustrated is a plan view of an embodiment of fixed tape control (FTC) application of a barrier tape 110 on a UTP cable incorporating a filler. FIG. 3E is not shown to scale; in many embodiments, barrier tape 110 may have a significantly larger width than the cable, such that the barrier tape 110 may overlap itself as discussed above in connection with FIG. 3C. The cable in FIG. 3E is enlarged to show detailed positioning of end portions 204 of terminal portions 202 of filler 108 and pairs 102 visible in channels between each terminal portion. As shown, the cable may include a helical twist at an angle $\theta_c$ 308 from an axis of the cable.

In FTC application, barrier tape 110 may be applied at a corresponding angle $\theta_t$ 310 with $\theta_c=\theta_t$. An edge of the tape 110, such as edge 306*b*, may be placed over an end portion 204 of a terminal portion 202. Accordingly, because angles 308, 310 are matched, the tape edge 306 will continue to follow the end portion 204 of the terminal portion without ever crossing above a channel or pair 102. This prevents electrical coupling of pairs 102 to conductive edges 306 of tape 110, and thus reduces leakage and ANEXT.

The FTC application provides superior control over ANEXT with low RL due to the avoidance of crossing of pairs by the barrier tape. However, because the angle $\theta_t$ 310 and placement of an edge 306 over a terminal portion 202 needs to be precisely controlled to prevent the edge from crossing beyond the end portion 204 of the terminal portion and over a channel, some manufacturing implementations may be expensive and/or require more experienced operators and machinists. In one extreme example, if angle $\theta_t$ 310 is equal to $\theta_c$ 308, but the tape placement is above a first pair of conductors 102, then the tape edge 306 will follow the pair of conductors around the cable continuously along their length, resulting in one pair of four having much higher ANEXT and RL. Similarly, with very long manufacturing runs of cable, even a minor difference in $\theta_c$ 308 and $\theta_t$ 310 will eventually result in the edge 306 being above a pair 102, resulting in lengths of cable that will fail to meet specification and must be discarded.

Figure 3G:
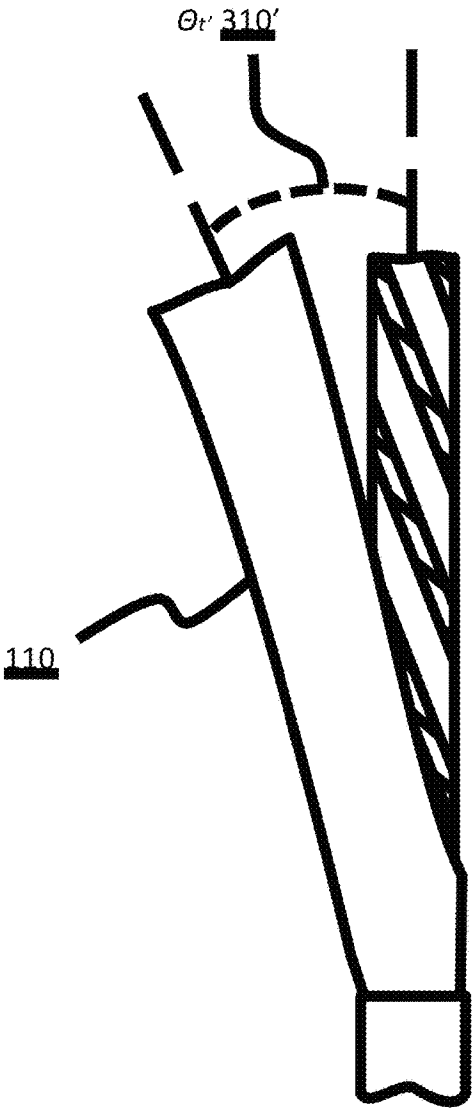
FIGS. 3F and 3G are plan views of an embodiment of oscillating tape control application of a barrier tape on a UTP cable incorporating a filler, in a first application angle and second application angle, respectively.
Figure 3F:
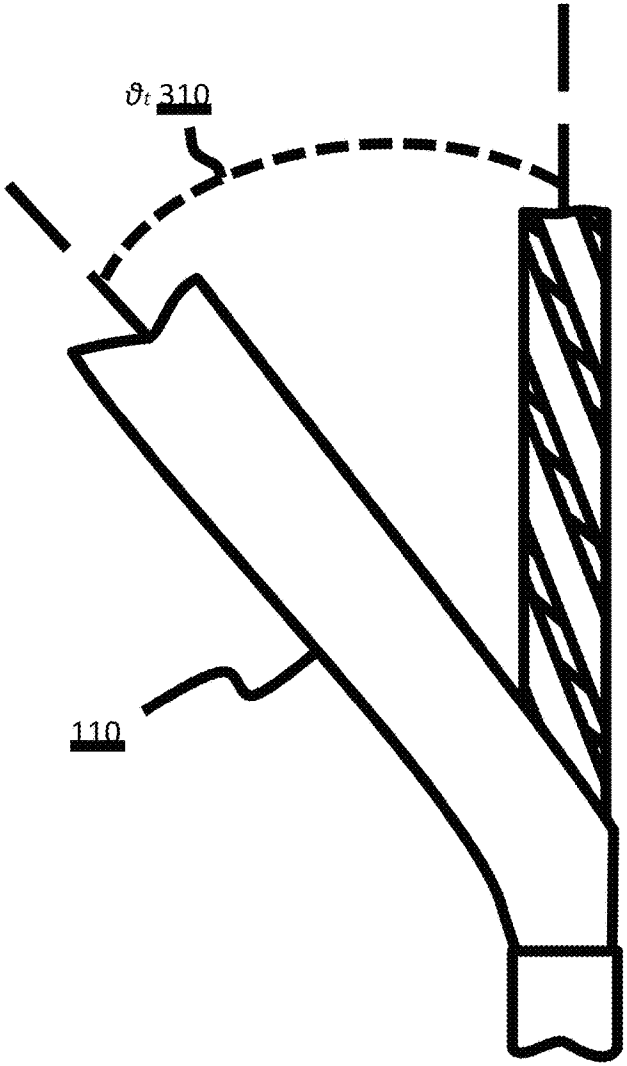

Instead, an acceptable tradeoff may be found by continuously varying the tape application angle $\theta_t$ 310, in an oscillating tape control (OTC) application method. FIGS. 3F and 3G are plan views of an embodiment of OTC application of a barrier tape on a UTP cable incorporating a filler, in a first application angle $\theta_t$ 310 and second application angle $\theta_{t'}$ 310', respectively. As with FIG. 3E, FIGS. 3F and 3G are not shown to scale, but show the cable enlarged to show detailed positioning of end portions of the terminal portions and pairs visible in channels between each terminal portion. In the OTC application method, the tape angle $\theta_t$ 310 is continuously varied from first angle $\theta_t$ 310 to second angle $\theta_{t'}$ 310' and back. As a result of the difference between $\theta_t$ 310 and $\theta_c$ 308, over a length of the cable, an edge 306 of barrier tape 110 will cross over all pairs 102, eliminating the extreme situation discussed above where the edge follows a single pair of conductors within the cable. This may be particularly useful in embodiments utilizing fillers 108' having smaller terminal portions, such as blunt terminal portions 203*a* as discussed above in connection with FIG. 2B. Furthermore, because the difference between $\theta_t$ 310 and $\theta_c$ 308 is being continuously varied, edge 306 will not cross any particular pair at a simple periodic interval. Because any such constant periodic intervals will correspond to some integer multiple of wavelengths at some frequency, the impedance discontinuities will compound resulting in increased RL at that frequency, adversely affecting the performance of the cable. Such problems are avoided via the OTC application method. In some OTC application methods, a filler need not be used, as the tape edge already crosses over the conductor pairs, or a filler may be a single-armed or flat separator between the pairs or have multiple arms, each of which end in a blunt terminal portion.

Figure 3H:
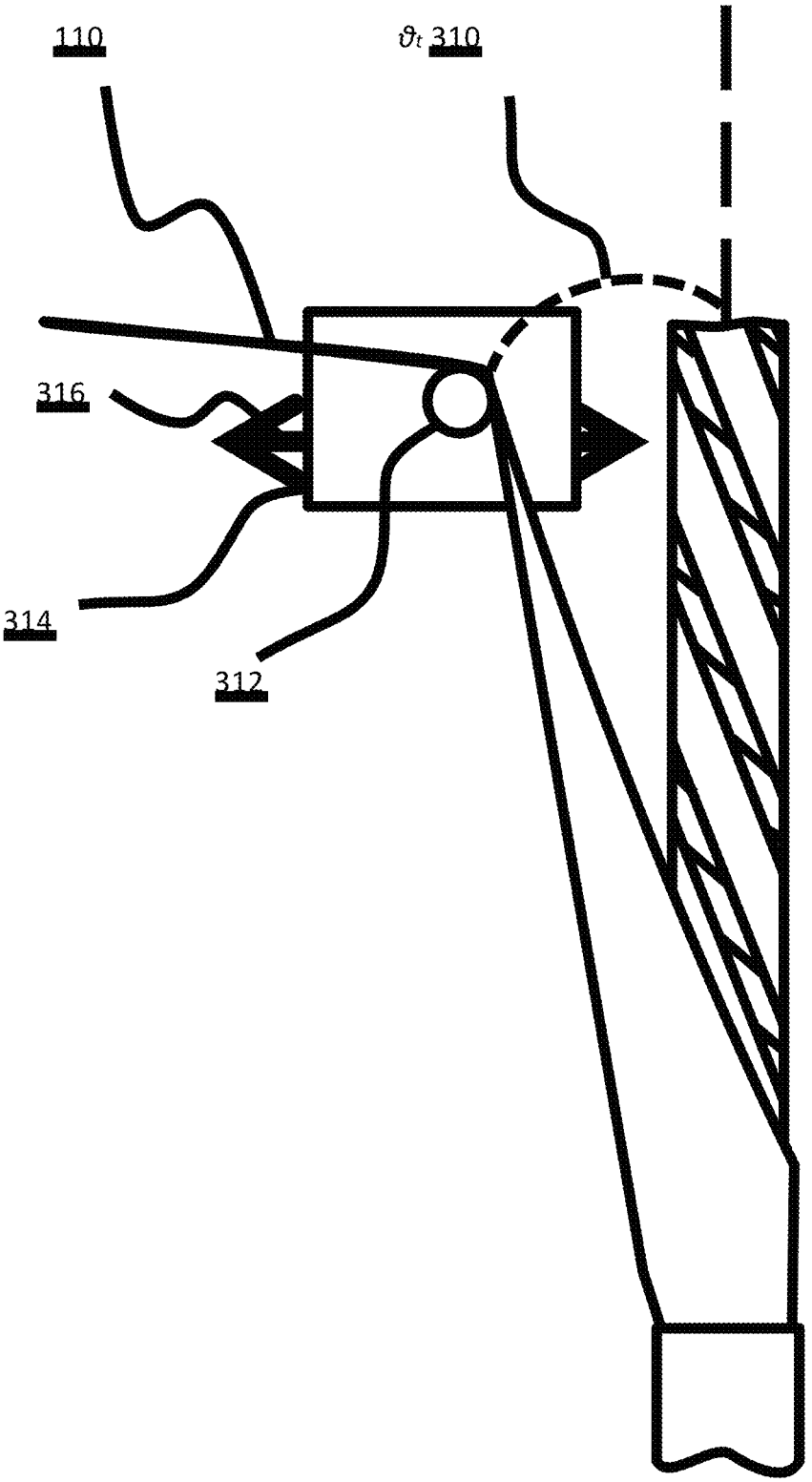
FIG. 3H is a diagram of an embodiment of a device for oscillating tape control application.

Referring briefly to FIG. 3H, illustrated is a diagram of an embodiment of a device for oscillating tape control installation. As with FIGS. 3E-3G, FIG. 3H is not shown to scale. In one embodiment of the device, a roller (or bar) 312 may be attached to a plate 314 which may be moved back and forth along a track of a predetermined length (illustrated by dashed line 316). Said roller or bar 312 may rotate with the barrier tape 110 during application to a cable, or may be fixed and have low friction such that barrier tape 110 may slide freely across the bar during application. Barrier tape 110 may extend from a feed source (not illustrated) and lay tangent to roller or bar 312 as shown, twisting as it leaves the roller or bar to helically wrap around the cable. As plate 314 and roller or bar 312 are moved back and forth along traverse 316, angle $\theta_t$ 310 is continuously varied. Traverse 316 may be of any length, and plate 314 and roller or bar 312 may be moved along the traverse at any speed. For example, given a 3" lay of the cable, traverse 316 may be 8 inches, 5 inches, 3 inches, or any other such length. Similarly, given a cable linear speed of 100 feet per minute, the stroke speed across the traverse 316 may be of a similar 100 feet per minute, 50 feet per minute, 10 feet per minute, or any other such speed. For example, in some implementations, the traverse speed may be between 3 to 20 inches per minute. Although variation in tape application angle $\theta_t$ 310 eliminates simple periodic relationships between pairs 102 and edges 306, the crossing will still be periodic at some extended length, as a factor of cable lay and advancement speed, plate/roller or bar stroke length, and plate/roller or bar stroke speed. Accordingly, certain combinations of length and speed may not have the desired levels of ANEXT and RL, depending on the required specification and frequency range.

Figure 4A:
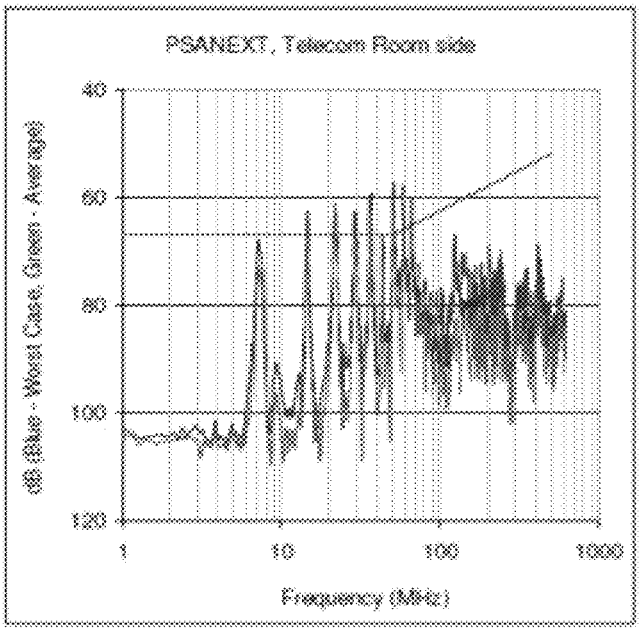
FIGS. 4A and 4B are charts and tables of measured PSANEXT and PSAACRF, respectively, for an embodiment of a UTP cable with a longitudinally applied barrier tape.
Figure 4A:
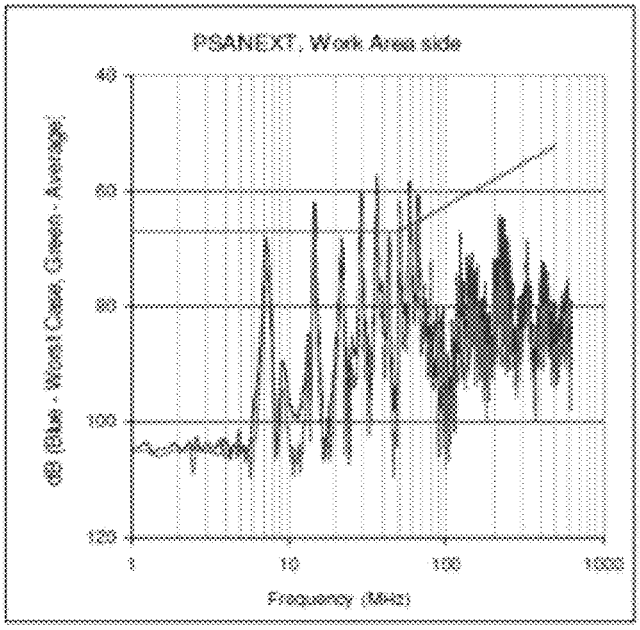
Figure 4B:
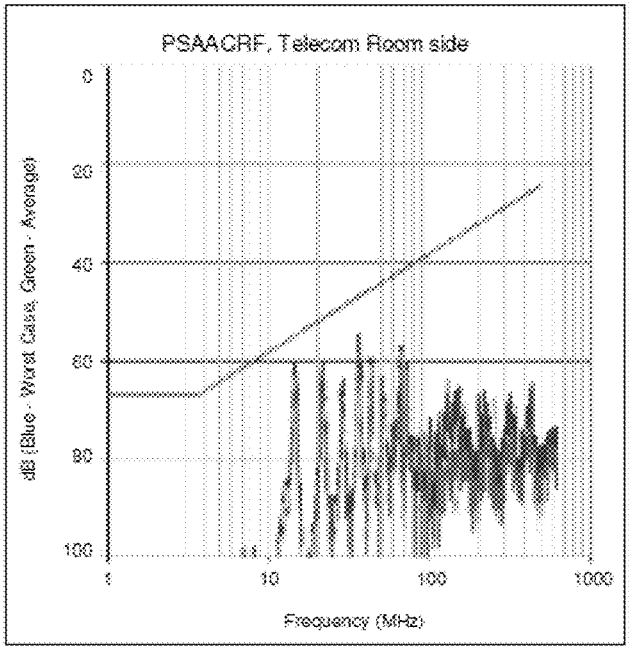
Figure 4B:
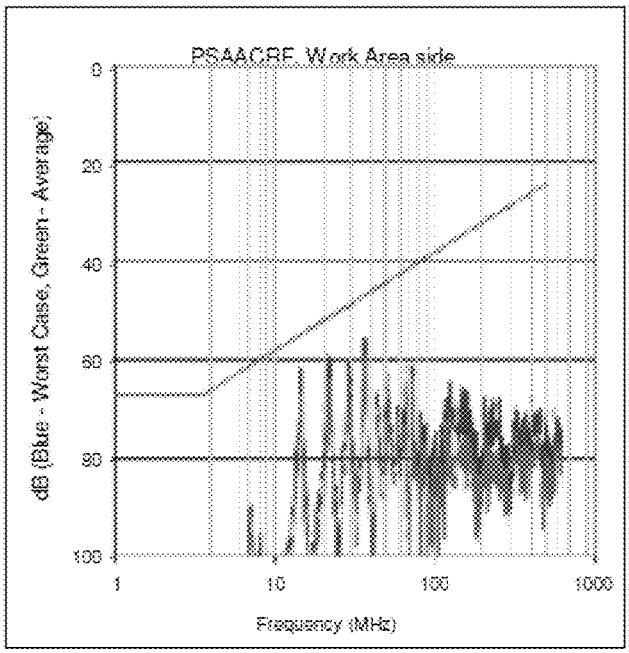

The FTC and OTC application methods result in significant improvements of ANEXT and RL compared to various tape application methodologies of barrier tapes used in typical cables. FIGS. 4A and 4B are charts and tables of measured power sum alien near end crosstalk (PSANEXT) and power sum alien attenuation to crosstalk ratio, far-end (PSAACRF), respectively, for an embodiment of a UTP cable with a longitudinal barrier tape. Unlike either the FTC or OTC implementations discussed above, edges of longitudinal barrier tape do not rotate around the cable, even as the pairs (and filler, in some implementations) rotate within the cable. Accordingly, tape edges frequently and periodically cross conductor pairs, resulting in the high levels of alien crosstalk shown. In the graphs and accompanying tables, frequencies are labeled in MHz; with alien crosstalk levels shown in decibels below nominal signal levels. Multiple tests were performed, with worst case and average results included. TIA specification levels are also shown and illustrated in the graphs in a solid red line.

Figure 5A:
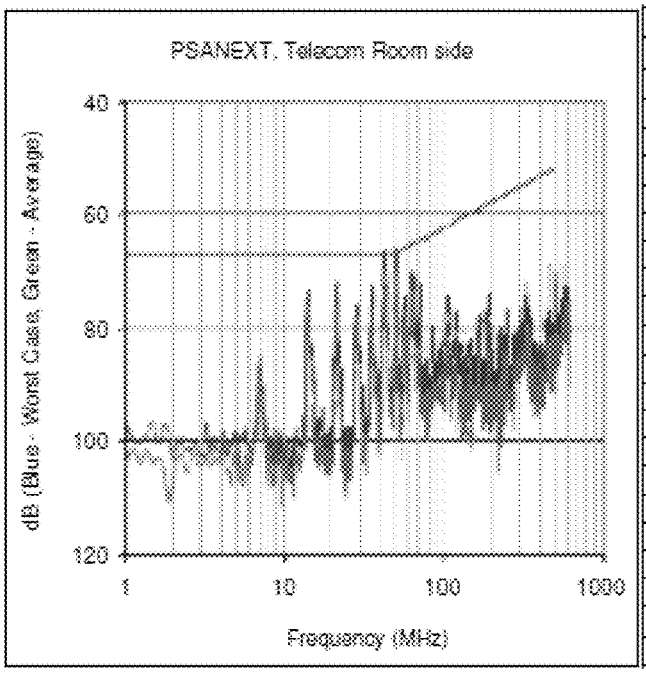
FIGS. 5A and 5B are charts and tables of measured PSANEXT and PSAACRF, respectively, for an embodiment of a UTP cable with a helically applied barrier tape.
Figure 5A:
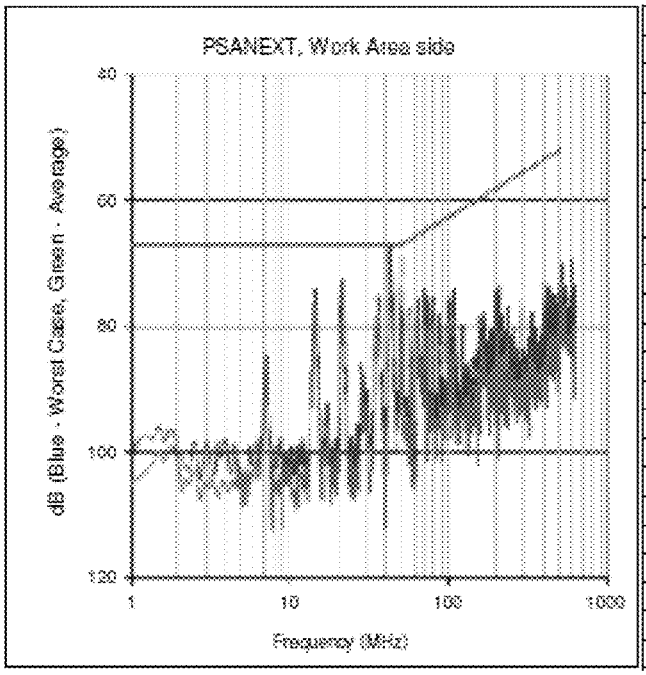
Figure 5B:
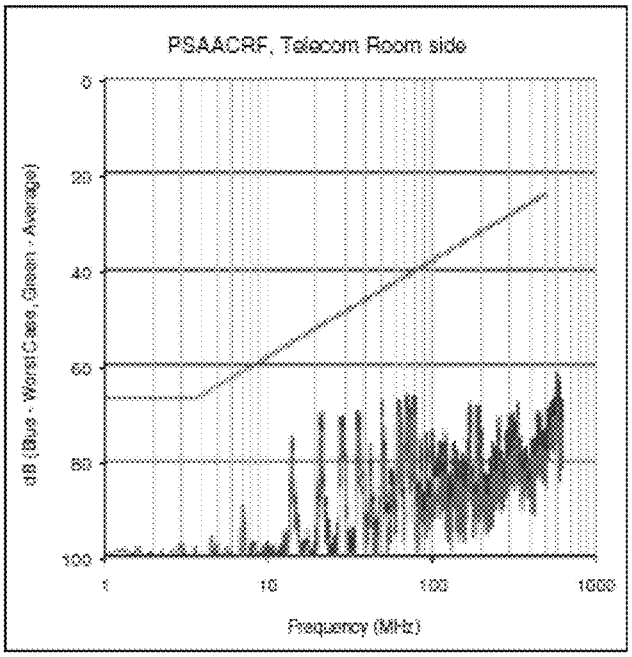
Figure 5B:
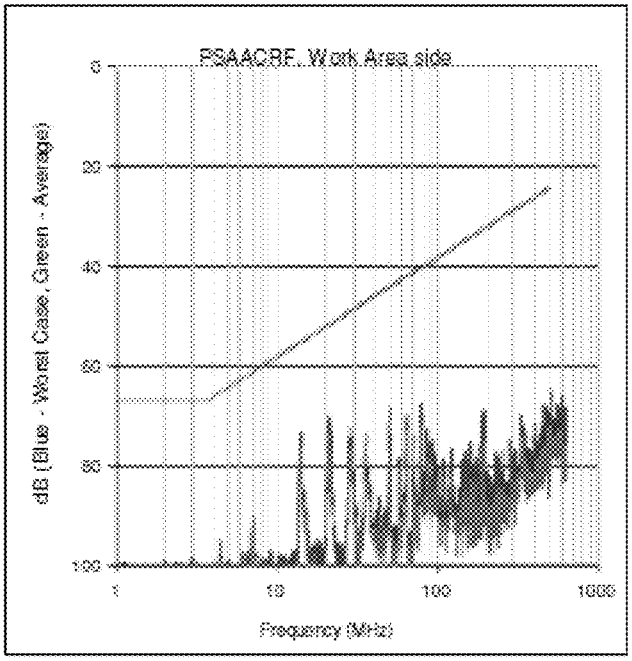

FIGS. 5A and 5B are charts and tables of measured PSANEXT and PSAACRF, respectively, for an embodiment of a UTP cable with a helically applied barrier tape with angle $\theta_t$ equivalent to cable lay angle $\theta_c$, As discussed above, in such embodiments, a tape edge is positioned over one of the conductor pairs, resulting in increased ANEXT.

Figure 6A:
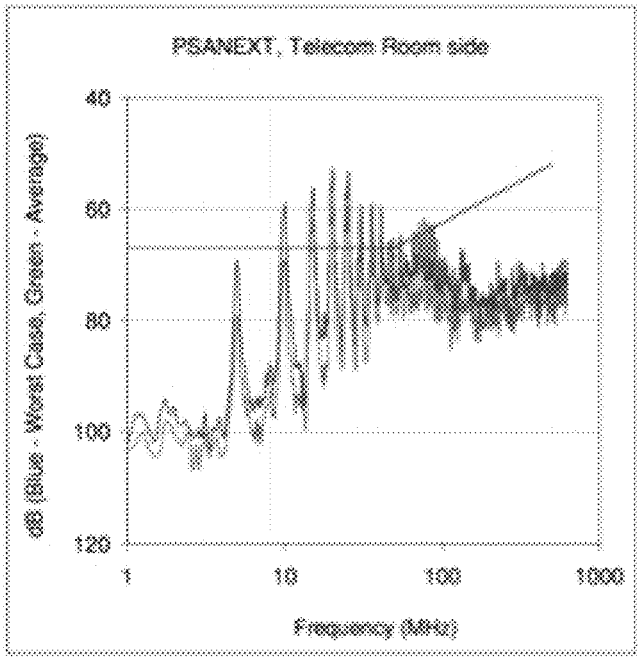
FIGS. 6A and 6B are charts and tables of measured PSANEXT and PSAACRF, respectively, for an embodiment of a UTP cable with a spirally applied barrier tape.
Figure 6A:
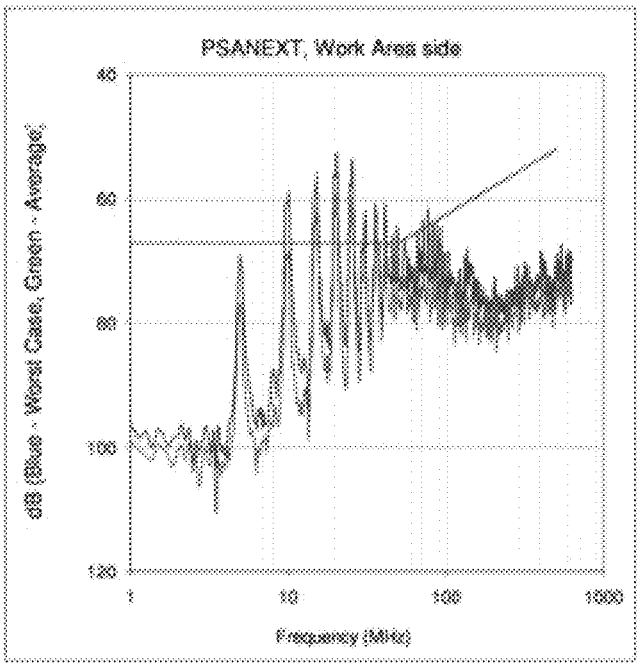
Figure 6B:
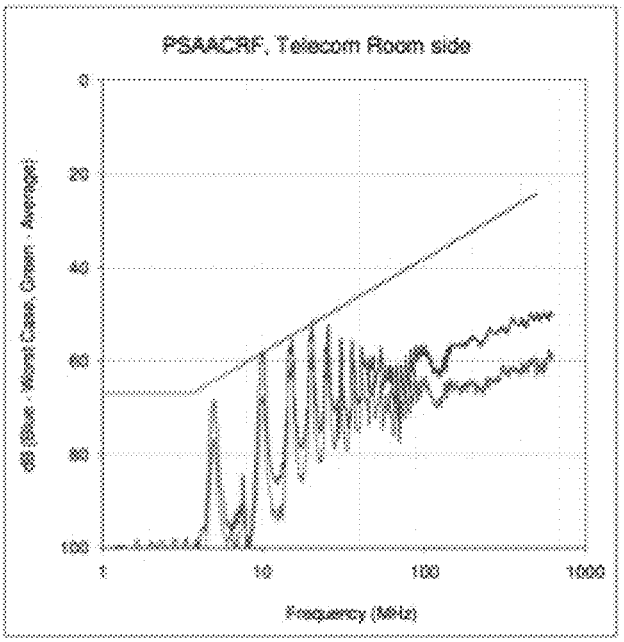
Figure 6B:
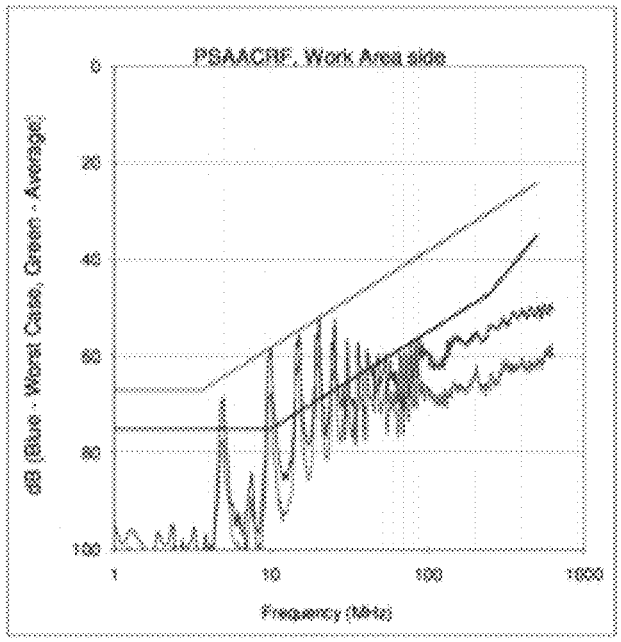

FIGS. 6A and 6B are charts and tables of measured PSANEXT and PSAACRF, respectively, for an embodiment of a UTP cable with a spirally applied barrier tape with angle $\theta_t$ different from cable lay angle $\theta_c$, but constant, as opposed to the OTC application discussed above. As discussed above, in such embodiments, a tape edge periodically crosses the pairs, resulting in increased ANEXT.

Figure 7A:
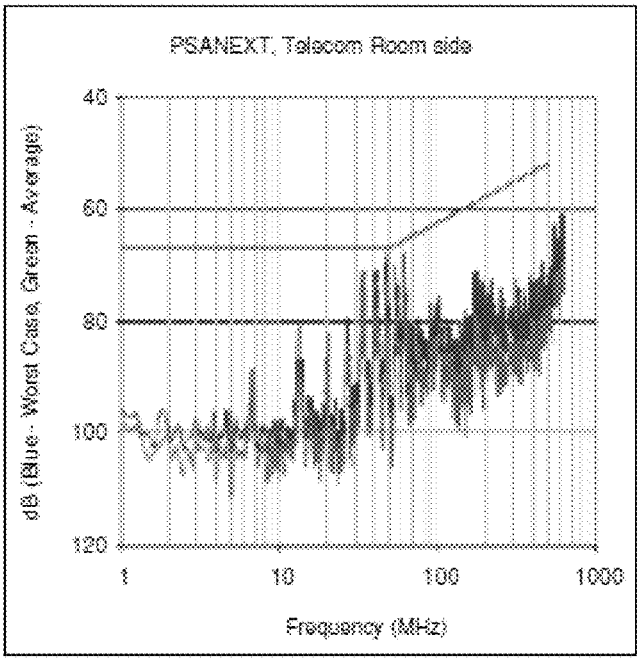
FIGS. 7A and 7B are charts and tables of measured PSANEXT and PSAACRF, respectively, for an embodiment of a UTP cable with a FTC method applied barrier tape having improper placement of a tape edge.
Figure 7A:
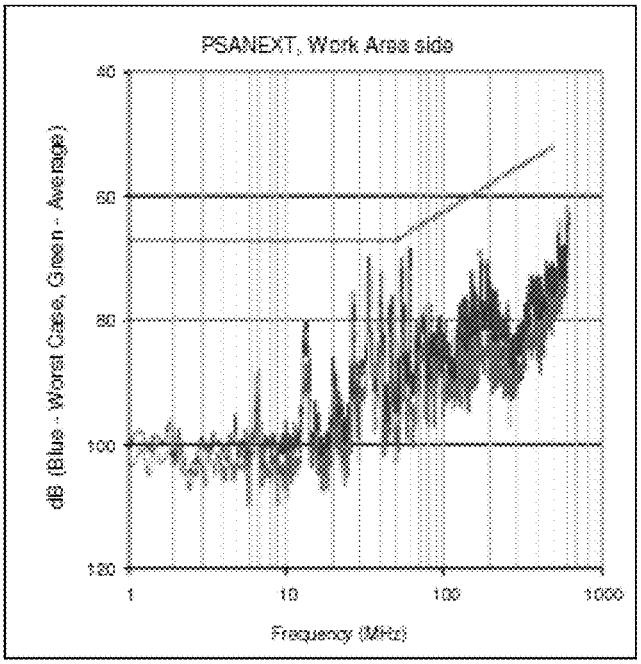
Figure 7B:
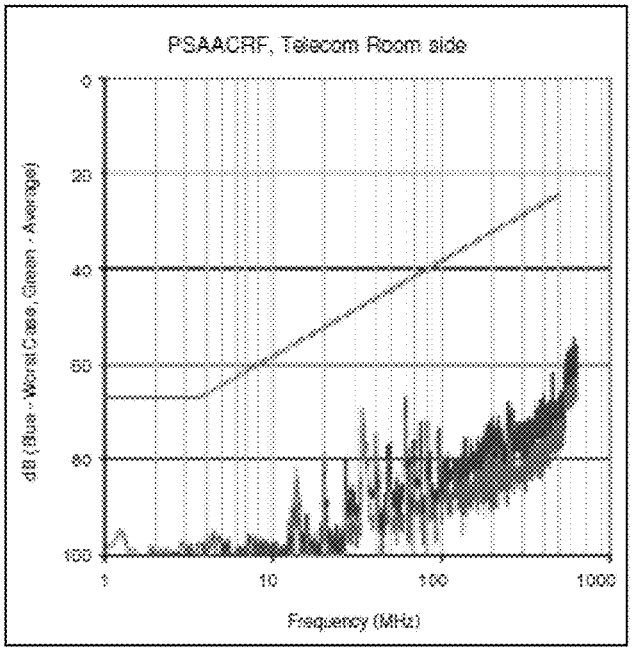
Figure 7B:
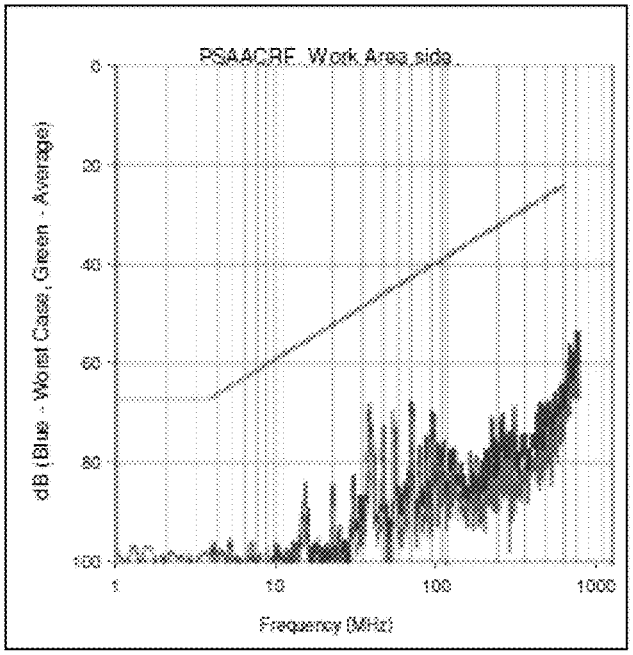

FIGS. 7A and 7B are charts and tables of measured PSANEXT and PSAACRF, respectively, for an embodiment of a UTP cable with a FTC helically applied barrier tape having improper placement of a tape edge, similar to the example in FIGS. 5A and 5B. Because the tape edge lies over a pair of conductors in this embodiment, the pair generates more ANEXT. While other pairs may have acceptable performance, the cable as a whole may not meet the specification requirements.

Figure 8A:
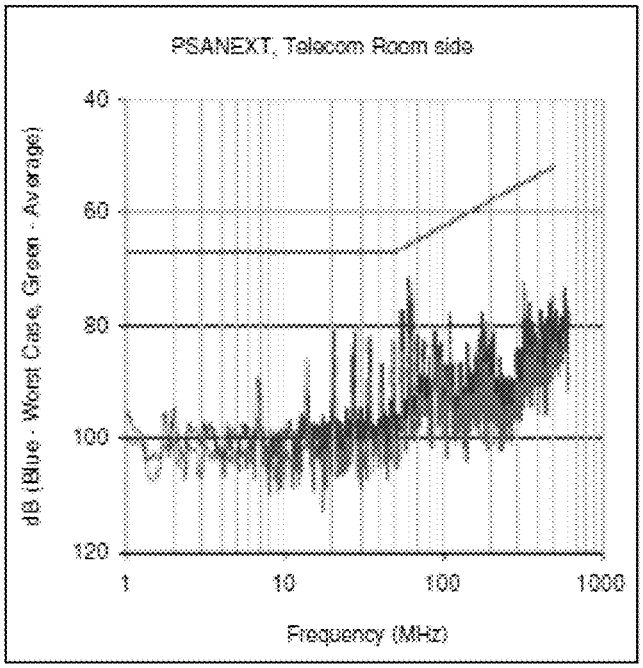
FIGS. 8A and 8B are charts and tables of measured PSANEXT and PSAACRF, respectively, for an embodiment of a UTP cable with a OTC method applied barrier tape.
Figure 8A:
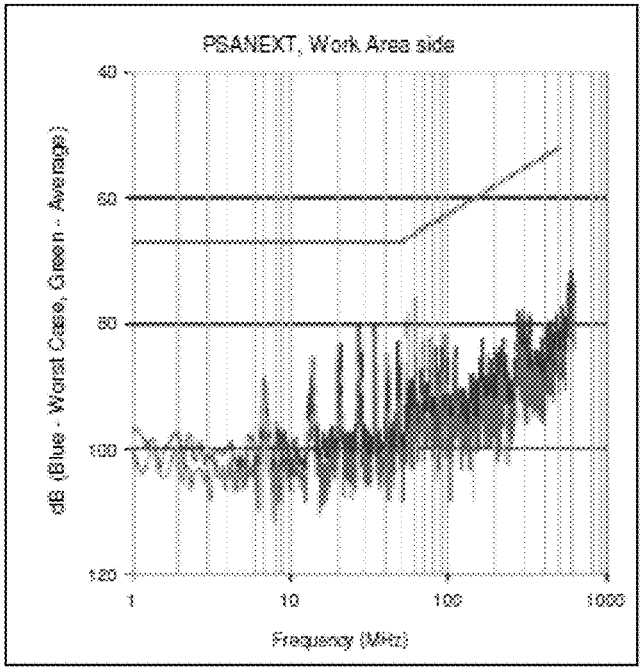
Figure 8B:
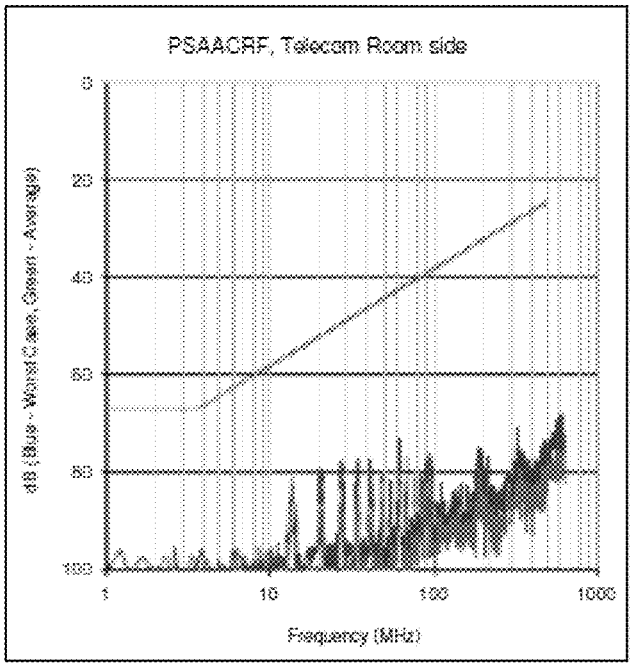
Figure 8B:
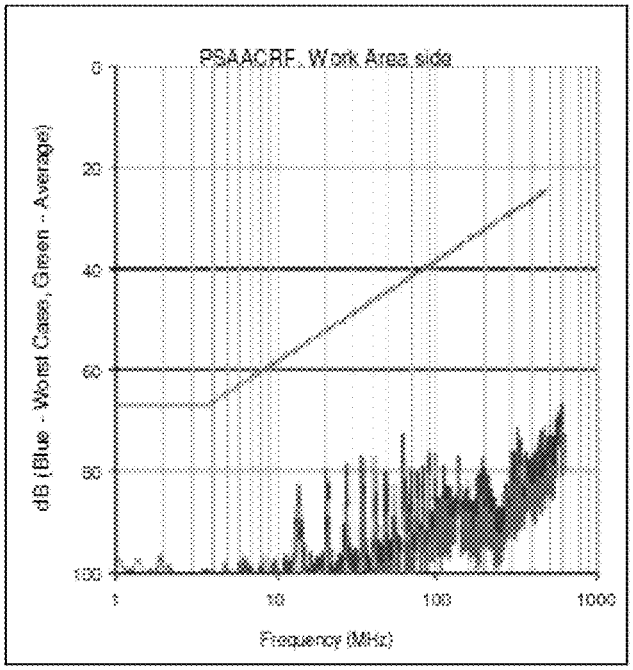

FIGS. 8A and 8B are charts and tables of measured PSANEXT and PSAACRF, respectively, for an embodiment of a UTP cable with an OTC helically applied barrier tape. As shown, ANEXT is significantly improved over the embodiments illustrated in FIGS. 4A-7B, while maintaining low manufacturing costs.

FIGS. 9A-9C are tables of measured return loss for embodiments of UTP cables with a longitudinally applied barrier tape, a helically applied barrier tape, and an OTC helically applied barrier tape, respectively. Each return loss test was performed multiple times, according to the values in the "count" column, and a mean, average worst case margin from the specification limit, and standard deviation were calculated from the results. The table also includes a Cpk index that quantifies the capability of a product's design and manufacturing process. Cpk is calculated as the headroom, defined as the average worst case result, divided by three times the standard deviation. The Cpk index value is proportional to a % defect rate, with a Cpk of 0.00 equal to a 50% defect rate, a Cpk of 0.40 equal to an 11.507% defect rate, a Cpk of 1.00 equal to a 0.135% defect rate, etc. Lower Cpk values accordingly indicate a higher likelihood of failure.

As shown, the return loss results for the OTC barrier tape cable were superior to the longitudinally applied barrier tape and helically applied barrier tape results, with no Cpk index value below 1.2, with the sole exception of one pair at the 550-625 MHz range, beyond the industry standard performance of 500 MHz Accordingly, the fixed and oscillating tape control cable application methods discussed herein and the geometry of the filler allow for significant reduction in ANEXT and return loss without increasing cost or cable diameter, and without requiring additional jacketing layers, complex tape design or wrapping systems, including discontinuous foil tapes, or additional steps during cable termination. Although discussed primarily in terms of Cat 6A UTP cable, fixed and oscillating tape application control may be used with other types of cable including any unshielded twisted pair, shielded twisted pair, or any other such types of cable incorporating any type of dielectric, semi-conductive, or conductive tape.

The above description in conjunction with the above-reference drawings sets forth a variety of embodiments for exemplary purposes, which are in no way intended to limit the scope of the described methods or systems. Those having skill in the relevant art can modify the described methods and systems in various ways without departing from the broadest scope of the described methods and systems. Thus, the scope of the methods and systems described herein should not be limited by any of the exemplary embodiments and should be defined in accordance with the accompanying claims and their equivalents.

What is claimed:

1. A cable for reducing alien cross-talk and return loss between adjacent twisted pairs of conductors comprising:

a first twisted pair of conductors having a first side portion and a first outwardly facing portion;

a second twisted pair of conductors having a second side portion and a second outwardly facing portion;

a filler member configured to non-conductively shield the first side portion of the first twisted pair of conductors from the second side portion of the second twisted pair of conductors;

a barrier tape configured to encircle the filler member and the first and second outwardly facing portions of the first and second twisted pairs of conductors so as to non-conductively shield the first and second outwardly facing portions of the first and second twisted pairs of conductors;

a jacket configured to encircle the barrier tape;

wherein the second twisted pair of conductors is located adjacent to a portion of the filler member, and wherein the first twisted pair of conductors is located adjacent to the portion of the filler member;

wherein the barrier tape includes a non-conductive layer and a conductive layer;

wherein the filler member is made of a non-conductive material;

wherein the filler member includes a plurality of arms that are each configured to radially extend outwardly so as to form a first channel shaped to partially enclose the first twisted pair of conductors and a second channel shaped to partially enclose the second twisted pair of conductors;

wherein the first terminal portion of the filler member includes a first outwardly facing terminal surface, the second terminal portion of the filler member includes a second outwardly facing terminal surface, and the barrier tape is configured to encircle the first and second outwardly facing terminal surfaces and the first and second twisted pairs of conductors;

wherein the filler member is configured to extend along a longitudinal portion of the cable and is configured to non-conductively shield the first and second twisted pairs of conductors from being electrically coupled to each other along the longitudinal portion of the cable.

2. The cable of claim 1, wherein the filler member comprises a single unitary component of the cable, and the plurality of arms of the filler member form a cross shape.

3. The cable of claim 1, wherein the non-conductive layer of the barrier tape comprises a first non-conductive layer and the barrier tape includes a second non-conductive layer.

4. The cable of claim 3, wherein the conductive layer of the barrier tape is positioned between the first and second non-conductive layers.

5. The cable of claim 3, wherein the first non-conductive layer comprises an inner non-conductive layer and the second non-conductive layer comprises an outer non-conductive layer.

6. The cable of claim 1, wherein the filler member and the barrier tape are configured to extend along a longitudinal direction of the cable.

7. The cable of claim 1, wherein the first and second twisted pairs of conductors comprise first and second helically twisted pairs of conductors along the longitudinal portion of the cable, and the filler member and the barrier tape are configured to non-conductively shield the first and second helically twisted pairs of conductors along the longitudinal portion of the cable.

8. The cable of claim 1, wherein the first and second twisted pairs of conductors comprise first and second helically twisted pairs of conductors along the longitudinal portion of the cable, and the filler member is configured to non-conductively shield the first and second helically twisted pairs of conductors along the longitudinal portion of the cable.

9. The cable of claim 1, wherein the filler member is helically twisted at a first angle relative to a longitudinal direction of the cable, and the barrier tape is configured to be helically twisted at a second angle relative to the longitudinal direction of the cable.

10. A cable for reducing electromagnetic interference between pairs of conductors in the cable comprising:

a first pair of conductors;

a second pair of conductors;

a non-conductive filler member configured to non-conductively separate the first pair of conductors from the second pair of conductors so as to reduce electromagnetic interference between the first and second pairs of conductors during operation of the cable;

a multi-layer barrier tape configured to encircle the non-conductive filler member and the first and second pairs of conductors, wherein the multi-layer barrier tape comprises a conductive layer positioned between a first non-conductive layer and a second non-conductive layer;

wherein the non-conductive filler member includes a first terminal portion and a second terminal portion;

wherein the non-conductive filler member and the multi-layer barrier tape are configured to reduce electromagnetic interference between the first and second pairs of conductors of the cable by non-conductively shielding the first and second pairs of conductors from being electrically coupled to each other.

11. The cable of claim 10, wherein the first pair of conductors comprises a first twisted pair of conductors, and the second pair of conductor comprises a first twisted pair of conductors.

12. The cable of claim 10, wherein the non-conductive filler member comprises a single unitary component of the cable, and the second pair of conductors is located adjacent to the first pair of conductors.

13. The cable of claim 10, further comprising a jacket configured to encircle the multi-layer barrier tape.

14. The cable of claim 10, wherein the non-conductive filler member includes a plurality of arms that are each configured to radially extend outwardly so as to form a first channel shaped to partially enclose the first pair of conductors and a second channel shaped to partially enclose the second pair of conductors.

15. The cable of claim 10, wherein the multi-layer barrier tape includes a non-conductive layer and a conductive layer.

16. The cable of claim 10, wherein the first non-conductive layer comprises an inner non-conductive layer and the second non-conductive layer comprises an outer non-conductive layer.

17. The cable of claim 10, wherein the non-conductive filler member is configured to extend along a longitudinal portion of the cable so as to non-conductively shield the first and second pairs of conductors along the longitudinal portion of the cable.

18. The cable of claim 10, wherein the first and second pairs of conductors are each twisted along a longitudinal portion of the cable, and the non-conductive filler member and the multi-layer barrier tape are configured to non-conductively shield the first and second pairs of conductors twisted along the longitudinal portion of the cable.

19. The cable of claim 10, wherein the first and second pairs of conductors are each helically twisted along a longitudinal portion of the cable, and the non-conductive filler member and the multi-layer barrier tape are configured to non-conductively shield the first and second pairs of conductors each helically twisted along the longitudinal portion of the cable.

20. The cable of claim 10, wherein the first pair of conductors comprises a first twisted pair of conductors, and the second pair of conductors comprises a second twisted pair of conductors.

21. The cable of claim 10, wherein the filler member and the multi-layer barrier tape are configured to extend along a longitudinal portion of the cable and are configured to reduce electromagnetic interference between the first and second pairs of conductors along the longitudinal portion of the cable by non-conductively shielding the first and second pairs of conductors from being electrically coupled to each other along the longitudinal portion of the cable.

22. A cable having reduced electromagnetic cross-talk between conductor pairs comprising:

a filler portion configured to electromagnetically separate a first conductor pair from a second conductor pair so as to reduce electromagnetic cross-talk between the first and second conductor pairs during operation of the cable;

a barrier portion configured to encircle the filler portion and the first and second conductor pairs so as to non-conductively shield the first and second conductor pairs and reduce electromagnetic cross-talk between the first and second conductor pairs during operation of the cable, wherein the barrier portion comprises a conductive layer positioned between a first non-conductive layer and a second non-conductive layer;

wherein the filler portion and the barrier portion are configured to reduce electromagnetic cross-talk between the first and second conductor pairs of the cable by non-conductively shielding the first and second conductor pairs from being electrically coupled to each other; and wherein the filler portion and the barrier portion are configured to extend along a longitudinal portion of the cable so as to reduce electromagnetic cross-talk between the first and second conductor pairs along the longitudinal portion of the cable.

23. The cable of claim 22, wherein the filler portion comprises a filler member, and the barrier portion comprises a tape member.

24. The cable of claim 23, wherein the filler member comprises a single unitary filler component of the cable, and the filler member and the tape member are separate and distinct components from each other.

25. The cable of claim 22, wherein the barrier portion comprises a multi-layer barrier tape.

26. The cable of claim 22, wherein the first conductor pair comprises a first twisted conductor pair, and the second conductor pair comprises a second twisted conductor pair.

27. The cable of claim 22, wherein the first conductor pair includes a first side portion and a first outwardly facing portion, and the second conductor pair includes a second side portion and a first outwardly facing portion.

28. The cable of claim 22, wherein the second conductor pair is located adjacent to the first conductor pair.

29. The cable of claim 22, further comprising a jacket configured to encircle the barrier portion.

30. The cable of claim 22, wherein the filler portion includes a plurality of arms that are each configured to radially extend outwardly so as to form a first channel shaped to partially enclose the first conductor pair and a second channel shaped to partially enclose the second conductor pair.

31. The cable of claim 22, wherein the barrier portion includes a non-conductive layer and a conductive layer.

32. The cable of claim 22, wherein the first non-conductive layer comprises an inner non-conductive layer and the second non-conductive layer comprises an outer non-conductive layer.

33. The cable of claim 22, wherein the first and second conductor pairs are each twisted along a longitudinal portion of the cable, and the filler portion and the barrier portion are configured to non-conductively shield the first and second conductor pairs twisted along the longitudinal portion of the cable.

34. The cable of claim 22, wherein the first and second conductor pairs are each helically twisted along a longitudinal portion of the cable, and the filler portion and the barrier portion are configured to non-conductively shield the first and second conductor pairs each helically twisted along the longitudinal portion of the cable.

35. The cable of claim 22, wherein the filler portion is helically twisted at a first angle relative to a longitudinal direction of the cable, and the barrier portion is configured to be helically twisted at a second angle relative to the longitudinal direction of the cable.

36. A cable having reduced electromagnetic cross-talk between conductor pairs comprising:

filler means for electromagnetically separating a first conductor pair from a second conductor pair so as to reduce electromagnetic cross-talk between the first and second conductor pairs during operation of the cable;

barrier means for encircling the filler means and the first and second conductor pairs so as to shield the first and second conductor pairs and reduce electromagnetic cross-talk between the first and second conductor pairs during operation of the cable, wherein the barrier means comprises a conductive layer positioned between a first non-conductive layer and a second non-conductive layer;

wherein the filler means and the barrier means are configured to reduce electromagnetic cross-talk between the first and second conductor pairs of the cable by non-conductively shielding the first and second conductor pairs from being electrically coupled to each other; and wherein the filler means and the barrier means are configured to extend along a longitudinal portion of the cable so as to reduce electromagnetic cross-talk between the first and second conductor pairs along the longitudinal portion of the cable.

37. The cable of claim 36, wherein the filler means comprises a filler member, and the barrier means comprises a tape member.

38. The cable of claim 37, wherein the filler member comprises a single unitary filler component of the cable, and the filler member and the tape member are separate and distinct components from each other.

39. The cable of claim 36, wherein the barrier means comprises a multi-layer barrier tape.

40. The cable of claim 36, wherein the second conductor pair is located adjacent to the first conductor pair.

41. The cable of claim 36, further comprising a jacket configured to encircle the barrier means.

42. The cable of claim 36, wherein the filler means includes a plurality of arms that are each configured to radially extend outwardly so as to form a first channel shaped to partially enclose the first conductor pair and a second channel shaped to partially enclose the second conductor pair.

43. The cable of claim 36, wherein the barrier means includes a non-conductive layer and a conductive layer.

44. The cable of claim 36, wherein the first non-conductive layer comprises an inner non-conductive layer and the second non-conductive layer comprises an outer non-conductive layer.

45. The cable of claim 36, wherein the first and second conductor pairs are each twisted along a longitudinal portion of the cable, and the filler means and the barrier means are configured to non-conductively shield the first and second conductor pairs twisted along the longitudinal portion of the cable.

46. The cable of claim 36, wherein the first and second conductor pairs are each helically twisted along a longitudinal portion of the cable, and the filler means and the barrier means are configured to non-conductively shield the first and second conductor pairs each helically twisted along the longitudinal portion of the cable.

47. The cable of claim 36, wherein the filler means is helically twisted at a first angle relative to a longitudinal direction of the cable, and the barrier means is configured to be helically twisted at a second angle relative to the longitudinal direction of the cable.

48. A cable comprising:

a plurality of twisted pair conductors;

a barrier tape that surrounds the plurality of twisted pair conductors, the barrier tape including an electrically conductive layer enclosed between inner and outer dielectric layers; and a jacket that surrounds the barrier tape.

49. A cable comprising:

a plurality of pairs of conductors extending along a longitudinal axis;

a barrier tape surrounding the plurality of pairs of conductors, the barrier tape comprising a conductive layer positioned between a first non-conductive layer and a second non-conductive layer; and an outer jacket surrounding the barrier tape, the outer jacket comprising a non-conductive material.

50. A method for reducing alien crosstalk between cables, the method comprising surrounding a plurality of twisted pair conductors with a barrier tape comprising a conductive layer positioned between a first non-conductive layer and a second non-conductive layer, and extending the barrier tape within an outer jacket.

* * * * *